US006052140A

United States Patent [19]

Yoshida

[11] Patent Number: 6,052,140

[45] Date of Patent: Apr. 18, 2000

[54] IMAGE FORMING APPARATUS

[75] Inventor: Futoshi Yoshida, Kanagawa, Japan

[73] Assignee: Fuji Photo Film Co., Ltd., Kanagawa, Japan

[21] Appl. No.: 09/000,798

[22] Filed: Dec. 30, 1997

[30] Foreign Application Priority Data

Jan. 8, 1997 [JP] Japan ..... 9-001272
Jan. 8, 1997 [JP] Japan ..... 9-001273

[51] Int. Cl.[7] ..... B41J 2/385

[52] U.S. Cl. ..... 347/234; 347/238; 347/240; 347/116; 347/248; 347/251

[58] Field of Search ..... 347/116, 234, 347/238, 240, 248, 251, 254

[56] References Cited

U.S. PATENT DOCUMENTS 5,635,976 6/1997 Thuren et al. ..... 347/253

*Primary Examiner*—N. Le
*Assistant Examiner*—Hai C. Pham
*Attorney, Agent, or Firm*—Sughrue, Mion, Zinn, Macpeak & Seas, PLLC

[57] ABSTRACT

A light source is used in which at least one row of light emitting elements, formed from a plurality of light emitting elements arranged along a predetermined direction, is provided. A plurality of scanning lines is recorded synchronously at one main scan operation and at least one scanning line is formed overlapping with each other in each main scan operation. In order that at least one scanning line is recorded in an overlapping region with the scanning lines overlapping each other by a combination of dots recorded by a preceding main scan operation and dots recorded by a succeeding main scan operation, emission of light from the light emitting elements is controlled based on image data. As a result, even if an error in an amount of movement in a sub-scan direction occurs, linear uneven density does not occur, and therefore, an image of high quality can be obtained.

16 Claims, 15 Drawing Sheets

IMAGE FORMING APPARATUS

BACKGROUND OF THE INVENTION

1. Field of the Invention

The present invention relates to an image forming apparatus, and particularly to an image forming apparatus in which a photosensitive material is exposed based on digital image data and an image corresponding to the digital image data is formed.

2. Description of the Related Art

There presently exists an image forming apparatus in which an image is formed on a recording medium by effecting a main scan operation and a sub-scan operation while modulating, based on digital image data, spot-shaped light beams (hereinafter referred to as "spot-light") emitted from a semiconductor laser or a light emitting diode (LED). Further, as this type of image forming apparatus, there exists an apparatus in which during a scan-exposure operation, the intensity of spot-light is modulated in accordance with digital image data so as to vary the density of dots to be formed, and dots having a density corresponding to the digital image data are formed on a recording medium.

As an image forming apparatus in which a light emitting diode (LED) is used as a light emitting element, an apparatus has been proposed in which a photosensitive material is exposed to light by effecting a main scan operation such that a plurality of scanning lines is synchronously recorded by a plurality of light emitting diodes arranged along a sub-scan direction. In this image forming apparatus, a predetermined range on the photosensitive material along the sub-scan direction can be exposed at one main scan operation by effecting a main scan operation synchronously using the plurality of LEDs each forming a line (hereinafter referred to as "main scan line") recorded by dots along the main scan direction and arranged along the sub-scan direction. Accordingly, even when a high-quality image is formed which has a high density of main scan lines, there is no possibility that the number of times of main scan increases. As a result, an image can be formed efficiently and in a short time.

However, when the predetermined range on the photosensitive material is exposed, the sub-scan operation needs to be effected to obtain an amount of movement corresponding to the predetermined range. At this time, when the amount of movement caused by the sub-scan operation cannot be correctly controlled, the space between a lowermost scan line in a preceding main scan operation and an uppermost scan line in a succeeding main scan operation varies from the space between scan lines recorded synchronously. As a result, streaked (i.e., linear) uneven density along the main scan direction is caused. Particularly, when exposure processing is effected repeatedly at a relatively wide range, the linear density unevenness is formed at fixed spaces and a finished quality of an image is thereby damaged.

SUMMARY OF THE INVENTION

In view of the above-described circumstances, an object of the present invention is to provide an image forming apparatus which can form an image having an excellent finished quality at high processing efficiency.

In order to achieve the above-described object, a first aspect of the present invention is an image forming apparatus comprising: a light source in which at least one row of light emitting elements, which is formed from a plurality of light emitting elements arranged along a predetermined direction, is provided; moving means which moves relatively at least one of the light source and a photosensitive material in a main scan direction crossing the predetermined direction and in a sub-scan direction along the predetermined direction; first control means which controls the moving means so that a plurality of scanning lines is recorded synchronously at one main scan operation and at least one scanning line is formed overlapping each other in each main scan operation; and second control means which controls emission of light of the light emitting elements based on image data so that at least one scanning line is recorded in an overlapping region, in which the scanning lines overlap each other, by a combination of dots recorded by a preceding main scan operation and dots recorded by a succeeding main scan operation.

The second control means of the first aspect can control as described below.

The second control means controls the emission in the overlapping region so that one of the dots recorded by the preceding main scan operation and the dots recorded by the succeeding main scan operation are recorded between other dots in the main scan direction.

The second control means controls the emission in the overlapping region in such a manner that the dots recorded by the preceding main scan operation and the dots recorded by the succeeding main scan operation are previously set.

The second control means controls the emission in the overlapping region so that the combination of the dots recorded by the preceding main scan operation and the dots recorded by the succeeding main scan operation varies in each overlapping region of adjacently overlapping regions.

The second control means controls the emission in the preceding main scan operation and the succeeding main scan operation with dots emitting light in the overlapping region being arranged in the sub-scan direction each at adjacent positions in the main scan direction.

The second control means controls the emission in the overlapping region so that at least a portion of one scanning line is recorded by combination of the dots recorded by the preceding main scan operation and dots recorded by the succeeding main scan operation in a state of overlapping with the dots recorded by the preceding main scan operation.

In this case, amounts of light of adjacent dots for recording one of the dots recorded by the preceding main scan operation and the dots recorded by the succeeding main scan operation are set differently.

In accordance with the first aspect of the present invention, at least one scanning line is overlapped in the overlapping region during two continuous exposure and a large number of exposure dots (dots) for forming all of the scanning lines in the overlapping region is formed at two main scan-exposure operations. It may be previously set or may be set each time which dots are formed by the preceding main scan operation or the succeeding main scan operation. Alternatively, an exposure pattern in which it is set which dots are formed by a current main scan-exposure operation may be determined, and based on the exposure pattern, light emitting elements corresponding to the overlapping region may be turned on.

As a result, all dots are formed in the overlapping region by a total of two main scan-exposure operations including the preceding and succeeding main scan in accordance with the exposure pattern and the scanning lines are thereby formed.

For this reason, even when an error in amount of movement occurs during sub-scan and the positions where dots for forming each of main scanning lines in the overlapping region are formed are displaced so that the dots are moved close to or apart from one another and spaces of the dots are made nonuniform, this nonuniform state occurs along the exposure pattern and does not extend linearly in the main scan direction accordingly. As a result, even if the error in the amount of movement in the sub-scan direction occurs, the occurrence of linear uneven density extending in the main scan direction can be prevented.

Accordingly, there is no possibility that the finished quality of an image is deteriorated by the linear uneven density, and an image of high quality (high resolution) can be efficiently formed.

Meanwhile, the dots recorded by the preceding main scan operation and the dots recorded by the succeeding main scan operation can be set irregularly in the overlapping region. For example, when a plurality of scanning lines belong to the overlapping region, any adjacent dots can be set intermittently so as not to be formed synchronously in one main scan operation.

On the other hand, when the adjacent dots in the overlapping region are recorded continuously along the main scan direction, a small continuous number of dots is preferable. As the continuous number of dots increases, the linear uneven density extending in the main scan direction is made noticeable.

Further, when the dots in the overlapping region are recorded in the preceding and succeeding main scan operations so that the different numbers of dots are arranged in the sub-scan direction at adjacent positions in the main scan direction, the continuously formed dots include dots formed continuously in the overlapping region and dots continuing from dots in a non-overlapping region. As a result, the dots located in the sub-scan direction in the overlapping region can be formed dispersedly in the main scan direction. The dispersed state of the dots in the sub-scan direction causes a recorded portion to be largely indented. For this reason, even if an error in amount of movement occurs during sub-scan, ununiformity of spaces of the dots is made into a largely indented state. Accordingly, occurrence of the linear uneven density extending in the main scan operation can be further prevented.

When dots in the overlapping region are recorded so that a portion of one scanning line is recorded by combination of the dots recorded by the preceding main scan operation and the dots recorded by the succeeding main scan operation, an amount of exposure of the each of dots for recording the portion of one scanning line comes to an amount of exposure corresponding to image data at two main scan-exposure operations.

As a result, even if an amount of movement during sub-scan occurs, respective dots formed by two exposure operations for forming one dot are formed to be displaced and the dots appear to be continuously formed by the displaced dots. For this reason, nonuniformity of the space of these dots is not made linear. Accordingly, the density in the main scan direction is made irregular and occurrence of density unevenness extending in the main scan direction can be prevented.

Meanwhile, each main scan-exposure operation can be effected by using the same amount of exposure in one main scan operation, i.e., an amount of light which is 50% of the amount of exposure corresponding to digital image data. When the dots having the amount of exposure described above are formed continuously in the main scan direction, a small continuous number of the dots is preferable. When the continuous number is low, occurrence of density unevenness extending in the main scan direction can be prevented. Further, when one dot is recorded by two exposure operations, the amounts of exposure of adjacent dots in a preceding exposure operation or in a succeeding exposure operation may be set at different values.

Further, when the plurality of scanning lines are included in the overlapping region, overlapped exposure may be selected for dots of all of the scanning lines or for dots of some of the scanning lines. When overlapped exposure is selected for all of the scanning lines, the scanning lines in the overlapping region are all formed by overlapped exposure. Further, when overlapped exposure is selected for some of the scanning lines, dots may be formed for the non-selected scanning lines in such a manner as described above.

Moreover, the exposure pattern can also be varied for each of the main scan operations. As a result, the dots to be set are varied for each of the main scan operations, and therefore, even if an error in amount of movement in the sub-scan direction occurs, there is no possibility that density unevenness caused by the above error is repeated in the sub-scan direction at a fixed cycle, and the linear uneven density extending in the main scan direction can be made further unnoticeable.

A second aspect of the present invention is an image forming apparatus comprising: a light source in which at least one row of light emitting elements, which is formed from a plurality of light emitting elements arranged along a predetermined direction, is provided; moving means which moves relatively at least one of the light source and a photosensitive material in a main scan direction crossing the predetermined direction and in a sub-scan direction along the predetermined direction; first control means which controls the moving means so that a plurality of scanning lines is recorded synchronously at one main scan operation and a region which can be recorded by a preceding main scan operation and a region which can be recorded by a succeeding main scan operation are partially overlapped with each other in each main scan operation; and second control means which control emission of light of the light emitting elements based on image data so that scanning lines belonging to an overlapping region with the recording regions overlapping each other are recorded in the overlapping region by combination of at least one scanning line recorded by the preceding main scan operation and at least one scanning line recorded by the succeeding main scan operation.

The second control means of the second aspect controls as follows.

The second control means controls the emission in the overlapping region so that one of the scanning line recorded by the preceding main scan operation and the scanning line recorded by the succeeding main scan operation are recorded between the other scanning lines.

The second control means controls the emission in the overlapping region in such a manner that the scanning line recorded by the preceding main scan operation and the scanning line recorded by the succeeding main scan operation are previously set.

The second control means controls the emission in the overlapping region in such a manner that the scanning line recorded only by the preceding main scan operation and the scanning line recorded only by the succeeding main scan operation are previously set.

The second control means controls the emission in the overlapping region so that at least one scanning line is recorded by the combination of the scanning line recorded by the preceding main scan operation and scanning line recorded by the succeeding main scan operation to overlap with the scanning line recorded by the preceding main scan operation.

The second control means controls the emission in the overlapping region in such a manner that light emitting elements emitting light in the preceding main scan operation and light emitting elements emit light in the succeeding main scan operation are previously set.

The second control means controls the emission in the overlapping region in such a manner that light emitting elements emit light only in the preceding main scan operation and light emitting elements emitting light only in the succeeding main scan operation are previously set. In this case, one of the light emitting elements emitting light only in the preceding main scan operation and the light emitting elements emitting light only in the succeeding main scan operation are located between the other light emitting elements.

The second control means controls the emission in the overlapping region by recording scanning lines in overlapping state with the light emitting elements, which emit light in the preceding main scan operation, emitting light even in the succeeding main scan operation.

In accordance with the second aspect of the present invention, recording of scanning lines belonging to the overlapping. region is effected by combination of a scanning line recorded by a preceding main scan operation and a scanning line recorded by a succeeding main scan operation. In order to allow the above recording of scanning lines, it suffices that light emitting elements to be turned on in the preceding main scan operation and light emitting elements to be turned on in the succeeding main scan operation be selected from light emitting elements for exposing the overlapping region and be turned on in accordance with each of the main scan operations. It may be previously set or may be set each time which light emitting elements are turned on in the preceding main scan operation or in the succeeding main scan operation. As a result, the exposure pattern during the main scan-exposure operation is determined. Based on the exposure pattern, the light emitting elements selected to be turned on in the preceding main scan operation are turned on to form a predetermined number of scanning lines, and the light emitting elements having not selected in the preceding main scan operation are turned on in the succeeding main scan operation to form remaining scanning lines.

As a result, in the overlapping region, the scanning line is further recorded by the succeeding main scan operation between the scanning lines recorded by the preceding main scan operation. Accordingly, even when an error in the amount of movement during sub-scan occurs and the amount of sub-scan and the actual amount of movement does not coincide with each other, the cycle at which the space of scanning lines is made nonuniform can be shortened. For this reason, even when the error in amount of movement during sub-scan occurs, the cycle at which the linear uneven density extending in the main scan direction appears can be shortened and the linear uneven density can be made unnoticeable as a whole.

Accordingly, deterioration of the finished quality caused by the linear uneven density is prevented and an image of high quality (high resolution) can be efficiently formed.

In the second aspect, the scanning lines in the overlapping region can be recorded by a combination of the scanning line (or lines) recorded by the preceding main scan operation and the scanning line (or lines) recorded by the succeeding main scan operation to be overlapped with the scanning line recorded by the preceding main scan operation. In order to achieve the above recording of scanning lines, among the light emitting elements for exposing the overlapping region, light emitting elements which are turned on in overlapped manner in the preceding main scan operation and the succeeding main scan operation are selected and set, and emission of light of the light emitting elements may be controlled to obtain an amount of exposure corresponding to image data by overlapped exposure.

In this case, at least one scanning line exposed in an overlapped manner is provided in the plurality of scanning lines in the overlapping region. The scanning line exposed in overlapped manner is previously set or set each time and the exposure pattern during the main scan-exposure operation is thereby determined. Based on the exposure pattern, scanning lines are formed in the overlapping region by effecting the preceding main scan operation in which the light emitting elements are turned on to obtain a predetermined amount of exposure. In the subsequent main scan operation, the light emitting elements are turned on to obtain a corresponding predetermined amount of exposure and a scanning line is formed to be overlapped with the previously formed scanning line.

As a result, at least one scanning line recorded by overlapping the preceding main scan-exposure operation and the succeeding main scan-exposure operation is formed in the overlapping region and the cycle at which the space of scanning lines is made nonuniform when the amount of sub-scan and the actual amount of movement do not coincide with each other can be shortened. As a result, even when the error in the amount of movement during sub-scan occurs, the spaces of linear uneven density extending in the main scan direction can be made narrow and the linear uneven density can be made unnoticeable as a whole.

Accordingly, deterioration of the finished quality caused by the linear uneven density is prevented and an image of high quality (high resolution) can be efficiently formed.

Meanwhile, the amount of exposure of scanning line exposed in overlapped manner is preferably set at 50% of the amount of light corresponding to digital image data. Further, as the scanning line recorded by overlapped exposure, either all or some of the scanning lines in the overlapping region may be selected. When all of the scanning lines is selected, the plurality of scanning lines in the overlapping region is all exposed in overlapped manner. Non-elected scanning lines are recorded in such a manner that only one of a pair of light emitting elements corresponding to the scanning line is caused to emit light.

In the second aspect of the present invention, in the adjacently overlapping regions, the scanning lines in the overlapping regions can be recorded by using different combinations of the scanning line recorded by the preceding main scan operation and the scanning line recorded by the succeeding main scan operation, respectively.

The second aspect of the present invention is constructed such that the scanning line selected from the scanning lines in the overlapping region so as to be exposed during the preceding main scan-exposure operation or the light emitting elements corresponding to the scanning line selected from the scanning lines in the overlapping region so as to be exposed in overlapped manner is selected differently for each of the main scan operations. For this reason, a pattern in which scanning lines are formed in the overlapping region can be varied for each of the main scan operations. As a result, in the image thus formed, even if the error in the amount of movement during sub-scan occurs, the linear uneven density caused by nonuniformity of the space of scanning lines is made irregular and is made further unnoticeable. Accordingly, the linear uneven density can be made unnoticeable as a whole.

As a result, deterioration of the finished quality caused by the linear uneven density is prevented and an image of high quality (high resolution) can be efficiently formed.

DESCRIPTION OF THE PREFERRED EMBODIMENTS

Overall Structure (Exterior View)

Figure 1:
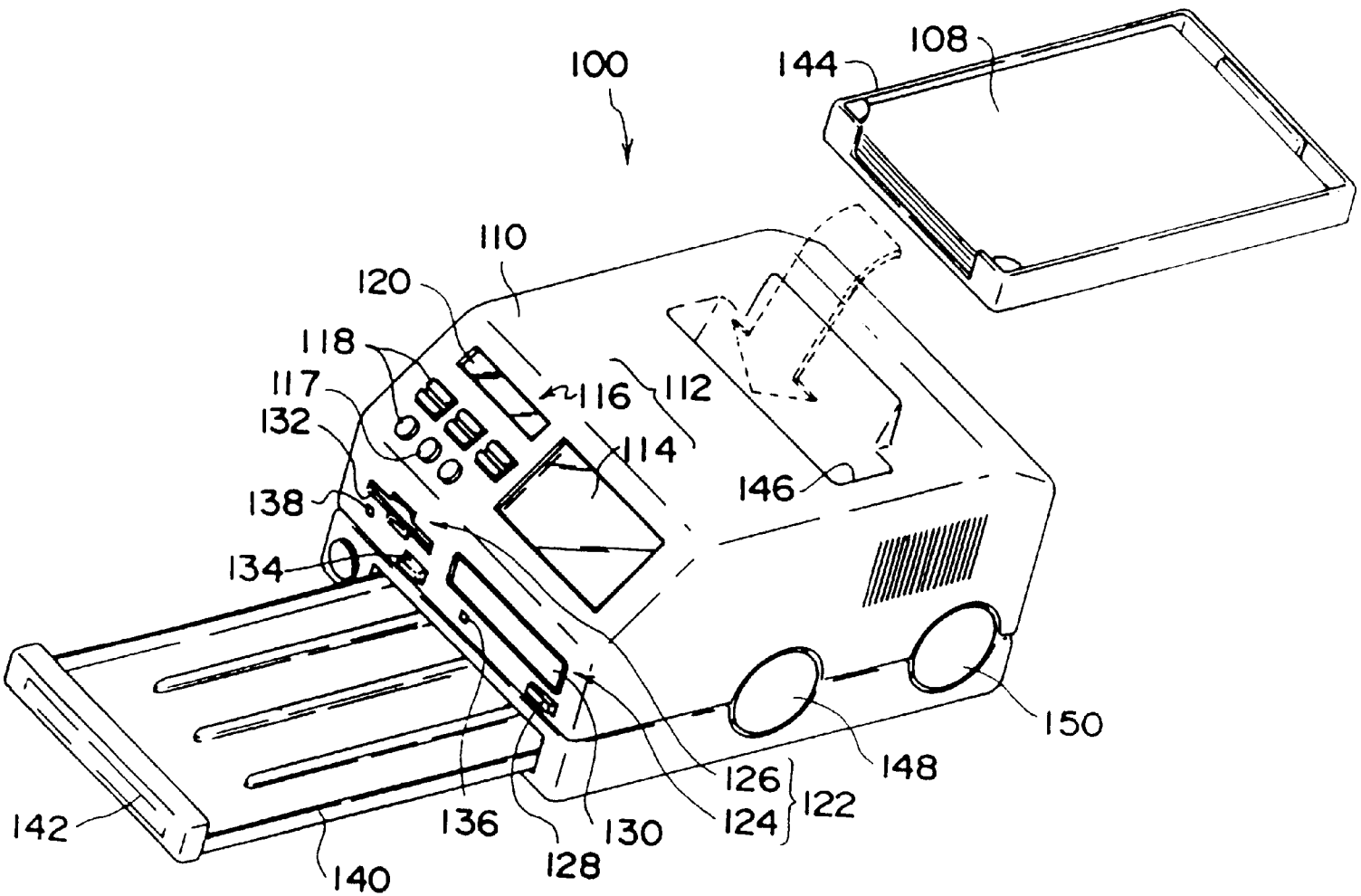
FIG. 1 is a perspective view of an image forming apparatus according to an embodiment of the present invention.
Figure 2:
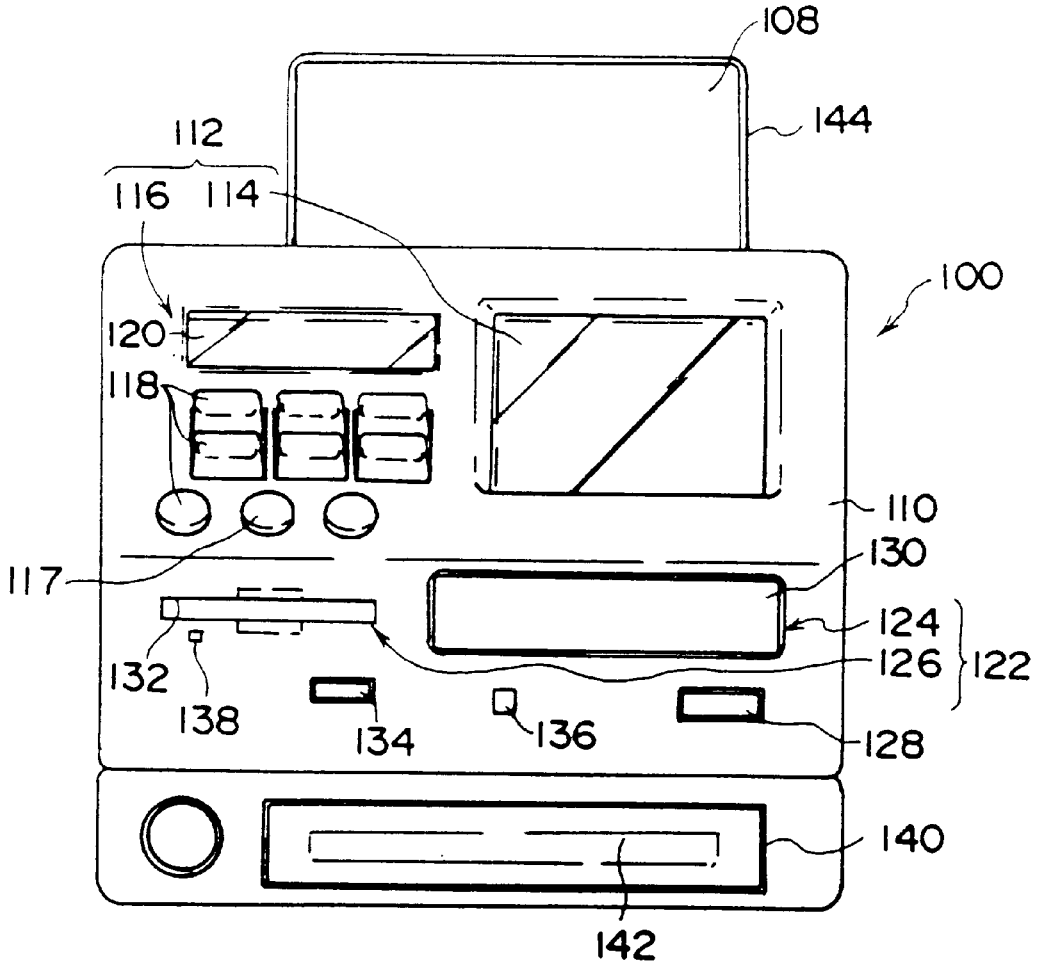
FIG. 2 is a front view of the image forming apparatus according to the embodiment of the present invention.
Figure 3:
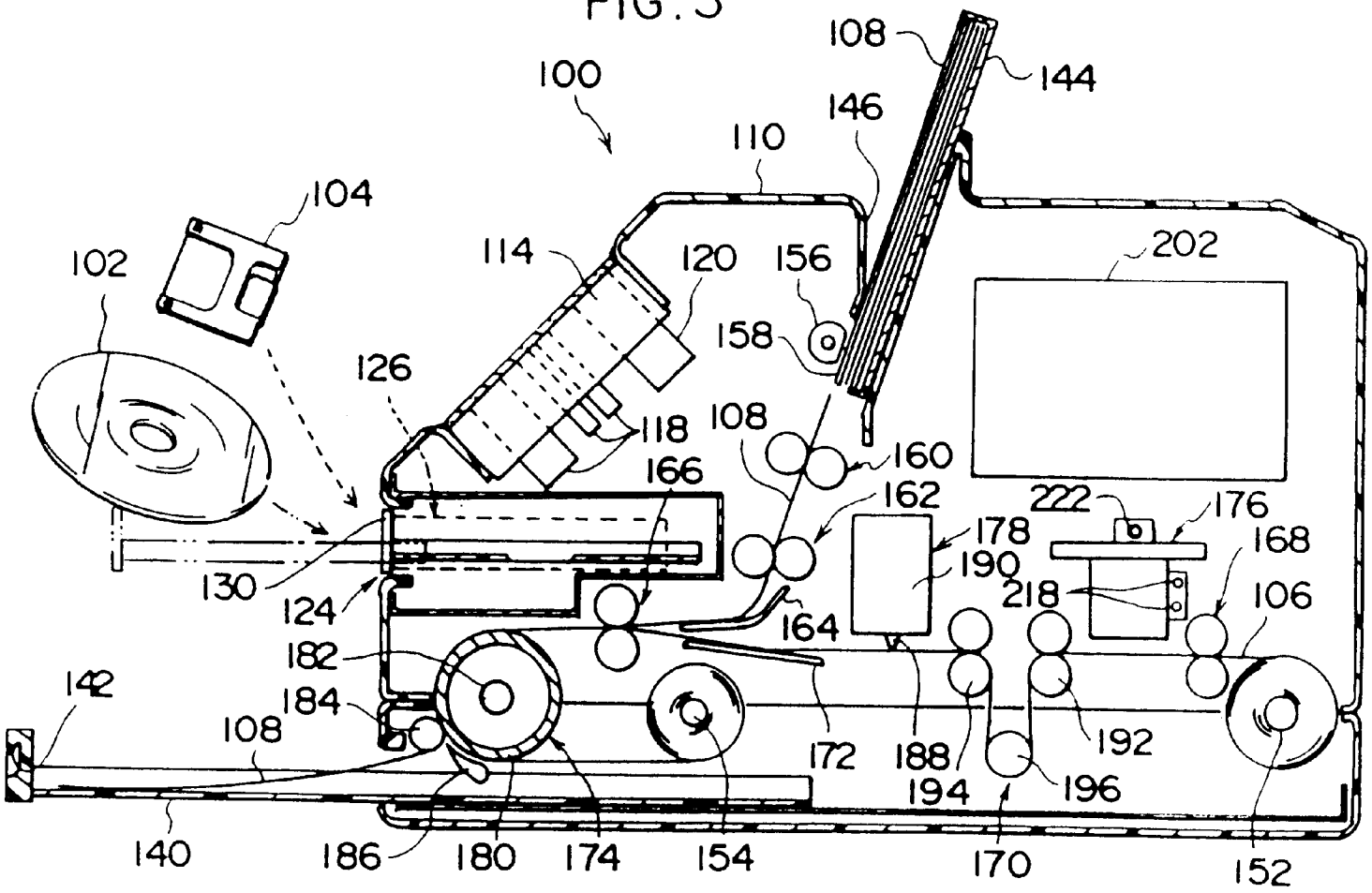
FIG. 3 is a cross-sectional side view showing an internal structure of the image forming apparatus according to the embodiment of the present invention.

Referring now to FIGS. 1 through 3, an image recording apparatus 100 according to an embodiment of the present invention is shown therein.

The image recording apparatus 100 reads image data recorded on an optical disk 102 or an FD 104 (which are both shown in FIG. 3) to expose onto a photosensitive material 106, and transfers an image recorded on the photosensitive material 106 to an image receiving paper 108 and outputs the image receiving paper 108.

An upper portion of the front surface of a box-shaped casing 110 (at the left side on the paper of FIG. 3) is formed as an inclined surface and an operation indicating portion 112 is provided thereon.

As shown in FIG. 2, the operation indicating portion 112 is divided into a monitor portion 114 and an input portion 116 which are disposed at right and left sides, respectively. The monitor portion 114 allows the read image to be projected thereon.

Further, the input portion 116 is formed by a plurality of operation keys 118 and a display portion 120 for confirmation of input data and can input data which is required for image formation, for example, the number of sheets to be recorded, size setting, color-balance adjustment, and negative/positive selection. These operation keys 118 includes pattern execution keys 117, which will be described later.

A deck portion 122 is provided below the operation indicating portion 112. The deck portion 122 is formed by an optical-disk deck portion 124 and an FD deck portion 126 which are disposed at right and left sides, respectively, on the paper of FIG. 2.

The optical-disk deck portion 124 is provided in such a manner that a tray 130 can be opened and closed by pressing an open/close button 128. An optical disk 102 can be loaded in an interior of the apparatus in such a manner as to be placed on the tray 130.

An FD insertion slot 132 is provided in the FD deck portion 126. When the FD 104 is inserted in the FD insertion slot 132, a drive system within the apparatus is actuated to insert the FD 104 into the apparatus. Further, in order to take out the FD 104 from the FD deck portion 126, an operation button 134 is pressed to pull out the FD 104.

Further, access lamps 136, 138 are respectively provided for the optical-disk deck portion 124 and the FD deck portion 126 and are each provided to be turned on during access within the apparatus.

A discharge tray 140 is provided further below the deck portion 122. The discharge tray 140 is usually accommodated within the apparatus and is provided to be pulled out by an operator's finger being put on a holding portion 142 (see FIG. 1).

The image receiving paper 108 on which the image is recorded is discharged onto the discharge tray 140.

The image receiving paper 108 is previously accommodated on a tray 144 in a layered form. The tray 144 is mounted in a tray mounting hole 146 formed on an upper surface of the casing 110. The image receiving papers 108 are taken out one by one from the tray 144 mounted in the tray mounting hole 146, and after images are transferred onto the image receiving papers 108, these image receiving papers 108 are guided to the discharge tray 140.

Two circular cover members 148, 150 are attached to the right side surface of the casing 110 (toward the front side on the paper of FIG. 1). These cover members 148, 150 are each provided to be independently removable. As shown in FIG. 3, a take-up reel 154 and a feed reel 152 onto which the rolled photosensitive material 106 is wound are disposed within the apparatus along axial directions of the cover members 148, 150, respectively. These reels 152, 154 can be taken out from or loaded into the apparatus in a state in which the covers 148, 150 are removed.

Image Receiving Paper Conveying System

As shown in FIG. 3, the tray 144 loaded in the tray mounting hole 146 is provided such that an upper surface of the leading end of the tray (at the side where the tray 144 is inserted into the tray mounting hole 146) faces a semicircular roller 156.

The semicircular roller 156 is formed in such a state that a cylindrical roller is cut along a plane parallel to an axis thereof. Usually, a cutting surface 158 of the semicircular roller 156 faces an uppermost image receiving paper 108 within the tray 144 with a space formed therebetween. When the semicircular roller 156 rotates, the image receiving paper 108 of the uppermost layer and the peripheral surface of the semicircular roller 156 contact each other, and the image receiving paper 108 is pulled out by a small amount when the semicircular roller 156 makes one rotation. The pulled-out image receiving paper 108 is nipped between a first roller pair 160 and is completely pulled out from the tray 144 by driving force of the first roller pair 160.

A second roller pair 162, a guide plate 164, and a third roller pair 166 are sequentially disposed at the downstream side of the first roller pair 160. The image receiving paper 108 is, after having been nipped by the first roller pair 160, nipped by the second roller pair 162, guided by the guide plate 164, and further nipped by the third roller pair 166.

The image receiving paper 108 overlaps with the photosensitive material 106 at the third roller pair 166. Namely, the third roller pair 166 is also used as a conveying path of the photosensitive material 106.

Photosensitive Material Conveying System

The photosensitive material 106 is accommodated in the apparatus in a state of being elongated and wound onto the feed reel 152 in a layered form. The feed reel 152 is mounted at a predetermined position in such a manner that the cover member 150 (at the rear side of the apparatus) is removed and the feed reel 152 is inserted into the apparatus in the axial direction thereof.

With the photosensitive material 106 being mounted at the predetermined position, loading of the photosensitive material 106 is effected along a predetermined conveying path with an outermost layer of the photosensitive material 106 being set as initialization. The photosensitive material 106 is loaded in such a procedure that the outermost layer thereof is pulled out from the feed reel 152, nipped by a fourth roller pair 168 in the vicinity of the feed reel 152, conveyed through a reservoir portion 170 and a guide plate 172, and is nipped by the third roller pair 166, and thereafter, the outermost layer is sequentially entrained onto a heat roller 174 and a take-up reel 154. In this case, a leader tape having a length required for loading may be provided at the leading end portion of the photosensitive material 106 wound onto the feed reel 152.

On the conveying path of the photosensitive material 106, an exposure section 176 is provided between the fourth roller pair 168 and the reservoir portion 170. Further, a water applying portion 178 is provided between the reservoir portion 170 and the guide plate 172. The exposure section 176 and the water applying portion 178 will be described later in detail. After the image has been exposed onto the photosensitive material 106 in the exposure section 176, the photosensitive material 106 is provided to overlap with the image receiving material 108 at the third roller pair 166 in a state in which water is applied to an emulsion surface (i.e., a surface to be exposed) of the photosensitive material.

Heat Roller

The heat roller 174 serves as a heat development-transfer section of the apparatus and is formed by a cylindrical roller main body 180 and a heater 182 provided within the roller main body 180 along the axial direction of the roller main body. The heat roller 174 serves to apply heat to members wound onto the roller main body 180 (i.e., the photosensitive material 106 and the image receiving material 108) in such a manner that the surface of the roller main body 180 is heated by actuation of the heater 182. The heating of the heat roller 174 enables heat development-transfer processing and the image recorded on the photosensitive material 106 is thereby transferred onto the image receiving paper 108.

A peeling roller 184 and a peeling claw 186 are disposed at a lower right side and in the vicinity of the heat roller 174 and are provided to separate, from the photosensitive material 106, the image receiving paper 108 wound onto the heat roller 174 by a length of about one third the overall circumference of the heat roller 174 to guide the image receiving paper 108 toward the discharge tray 140.

On the other hand, the photosensitive material 106 is wound onto the heat roller 174 by a length of about a half the overall circumference of the heat roller and is turned to an opposite direction to be guided to a position where the take-up reel 154 is mounted.

Water Applying Portion

As shown in FIG. 3, the water applying portion 178 operates to apply water, serving as an image forming solvent, onto the photosensitive material 106 or the image receiving paper 108 to allow overlapping surfaces of the photosensitive material 106 and the image receiving paper 108 to closely adhere to each other for heat development. The water applying portion 178 is formed by an applying member 188 extending along a transverse direction of the photosensitive material 106 and a tank 190 in which water is filled.

The applying member 188 is formed of a high water-absorptive material, for example, felt, sponge, or the like, having a proper degree of hardness and is provided to contact the photosensitive material 106 at a predetermined pressure during conveying of the photosensitive material 106. Water filled in the tank 190 is constantly supplied to the applying member 188 by a proper amount by taking advantage of capillary phenomenon. When the photosensitive material 106 and the applying member 188 contact each other, water is applied onto the surface (i.e., the emulsion surface) of the photosensitive material 106 by the applying member 188.

Further, since the applying member 188 abuts against the photosensitive material 106 at a proper pressure, water is uniformly applied to the photosensitive material 106.

Replenishment of water into the tank 190 is effected in such a manner that the entire water applying portion 178 is removed from the apparatus, but water may be constantly supplied from an exterior of the apparatus by using a pipe arrangement.

Meanwhile, in the present embodiment, water is used as the image forming solvent, but the water used in this embodiment is not limited to pure water and also includes water which is widely and generally used. Further, a mixed solvent of water and a low-boiling-point solvent such as methanol, DMF, acetone, diisobutylketone, or the like may be used. Moreover, a solution which contains an image formation accelerator, an anti-fogging agent, a development stopping agent, hydrophilic heat solvent, or the like may also be used.

Exposure Section

Figure 4:
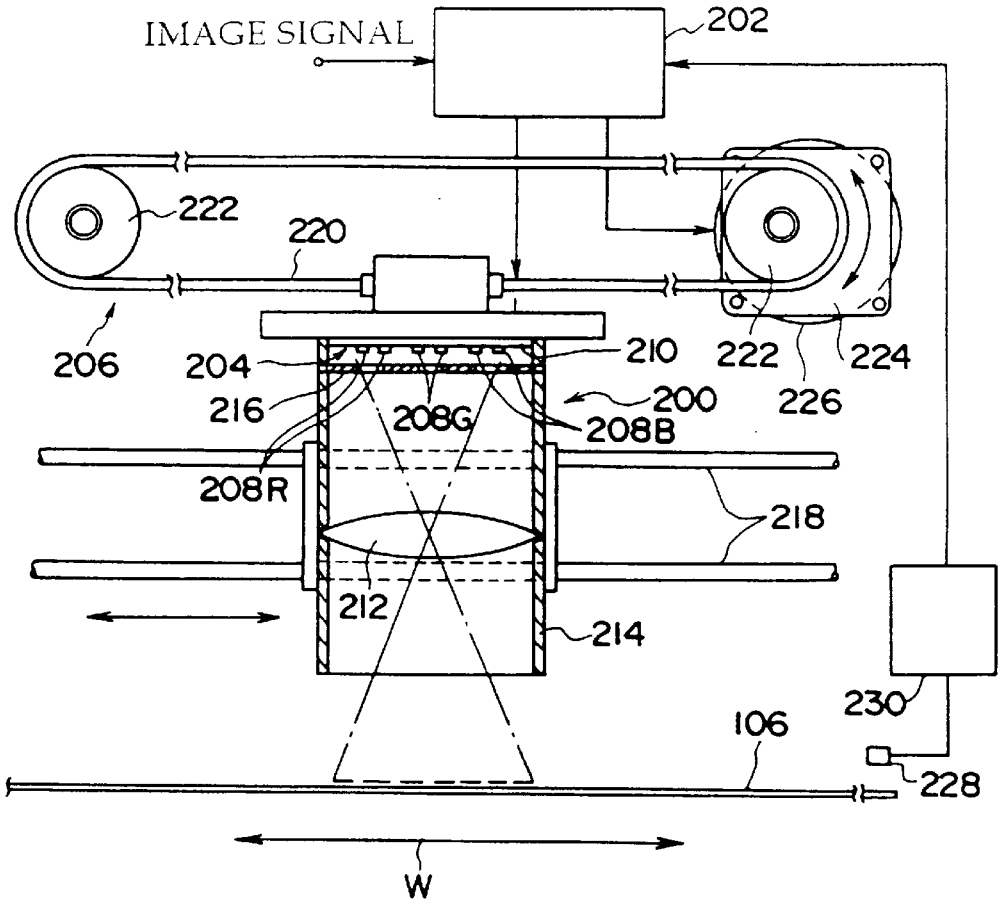
FIG. 4 is a front view showing a schematic structure of an exposure section.

FIG. 4 shows an exposure section 176 according to the present embodiment.

The exposure section 176 is mainly formed from a light source unit 200 provided above the conveying path of the photosensitive material 106 and is connected to a controller 202. The controller 202 stores digital image data (i.e., image data read from the optical disk 102 or FD 104) and turns on a light source portion 204 within the light source unit 200 in accordance with the digital image data.

The light source unit 200 is provided to be movable in the transverse direction of the photosensitive material 106 (i.e., the main scan direction) in such a manner as to be driven by a main scanning unit 206 corresponding to scanning means of the present invention, which will be described later. The main scanning operation is effected when the photosensitive material 106 is step-driven and stops in the exposure section 176.

The light source unit 200 of the exposure section 176 is covered by a box-shaped exposure casing 214. The light source portion 204 is disposed on the upper end surface of the exposure casing 214 and a light emission surface of the light source portion 204 is directed toward an interior of the exposure casing 214. An aperture 216 is provided for each of colors on the side of the light emission surface of the light source portion 204 to limit scattering of light from a plurality of LED chips 208 (208R, 208G, 208B). Meanwhile, the structure having no aperture 216 may also be provided.

A telecentric lens 212 is provided in a supporting portion which is disposed at the downstream side of the apertures 216 and at the central portion of the exposure casing 214 and serves to converge light from predetermined light source portion 204 to form an image on the photosensitive material 106 at an appropriate focusing. Meanwhile, the resolution of an image thus formed is about 250 to 400 dpi.

The telecentric lens 212 is formed by a plurality of lenses and a diaphragm and has characteristics in which magnification thereof does not vary even when the height of an image surface changes. The telecentric lens 212 can eliminate vibration generated during the main scan movement made by the main scanning unit 206, and an error caused by a state in which the exposure casing 214 is mounted.

Further, the overall focusing is constantly adjusted by an automatic focusing mechanism (not shown). Alternatively, the telecentric lens 212 may also be formed as a lens system whose depth of focus is large so as to eliminate the need of adjustment of focusing.

The light source portion 204 is supported by a pair of guide shafts 218 disposed parallel to each other and forming a part of the main scanning unit 206. These guide shafts 218 are provided along the transverse direction of the photosensitive material 106 (i.e., the direction indicated by arrow W in FIG. 4). The light source portion 204 is guided by the guide shafts 218 so as to be movable in the transverse direction of the photosensitive material 106.

A portion of an endless timing belt 220 is fixed at the exposure casing 214 of the light source portion 204. The timing belt 220 is entrained onto sprockets 222 positioned in the vicinities of both ends of the pair of guide shafts 218. The rotating shaft of one of the sprockets 222 is connected via a transmission 224 to the rotating shaft of a stepping motor 226. Due to reciprocating rotation of the stepping motor 226, the light source portion 204 is moved along the guide shafts 218 in a reciprocating manner.

Figure 6:
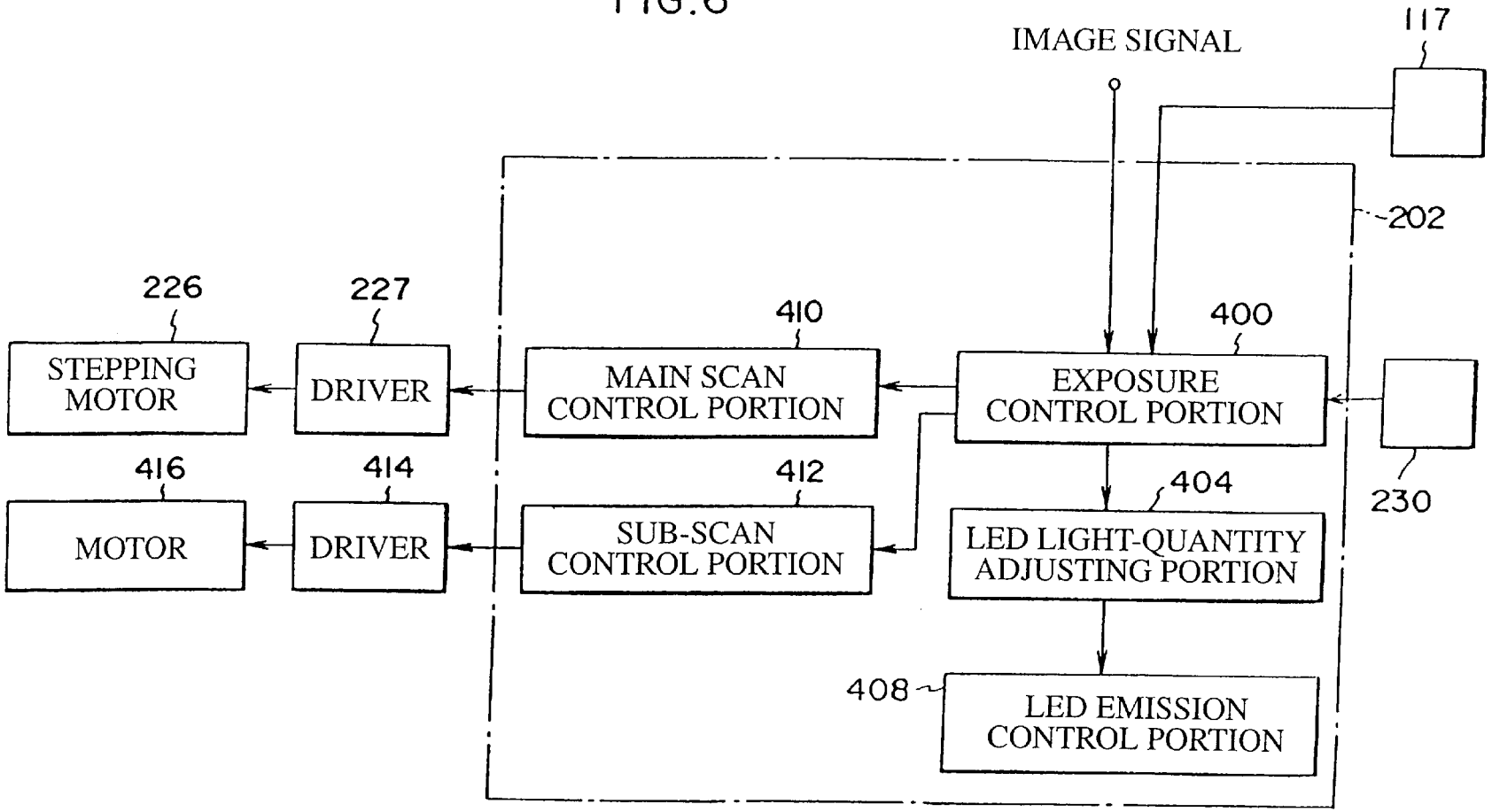
FIG. 6 is a functional block diagram of a controller.

As shown in FIG. 6, the stepping motor 226 is connected to the controller 202 via a driver 227. The drive of the stepping motor 226 is controlled by the controller 202 and is synchronized with the step driving of the photosensitive material 106. Namely, in the state in which the photosensitive material 106 is moved by one step and stops, the stepping motor 226 starts rotating to move the light source portion 204 on the photosensitive material 106 along the transverse direction of the photosensitive material 106. When the stepping motor 226 is rotated in the reverse direction after a predetermined number of pulses has been confirmed, the light source portion 204 returns to its original position. Subsequent movement of the photosensitive material 106 starts synchronously with the returning motion of the light source portion 204.

As shown in FIG. 4, a photodiode 228 is provided at the side where light is emitted from the light source portion 204 so as to face the photosensitive material 106 and outputs a signal corresponding to a quantity of light from the light source portion 204 in which light has been received. The photodiode 228 is connected to a light-quantity correction unit 230 and the signal corresponding to the quantity of light is inputted to the light-quantity correction unit 230.

The light-quantity correction unit 230 compares the quantity of light from the LED chips 208 of each of the detected colors with a quantity-of-light value predicted from a correcting fixed signal to adjust density and color balance, and further outputs a correction value to the controller 202.

Figure 5:
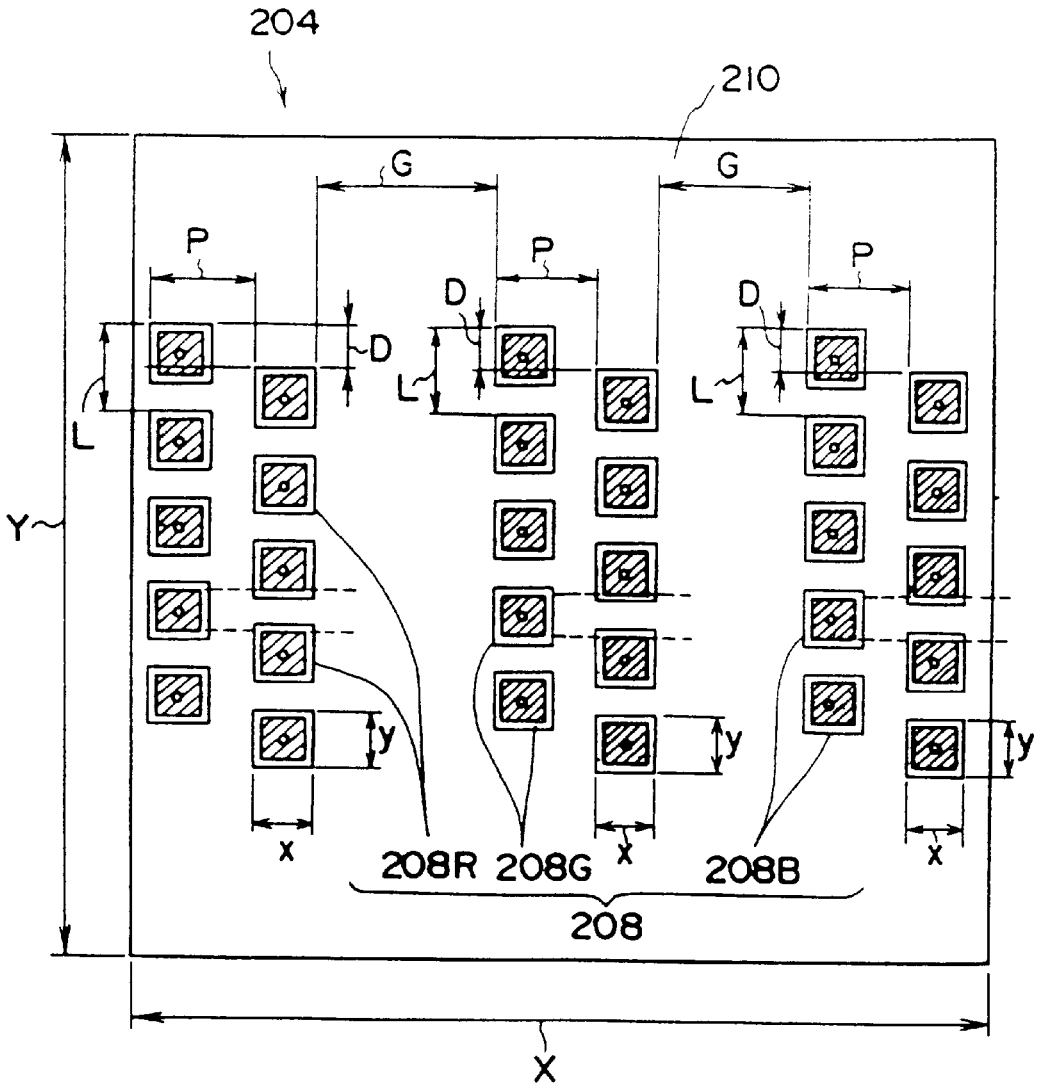
FIG. 5 is a plan view showing a light source portion of the exposure section.

As shown in FIG. 5, the light source portion 204 is formed with the plurality of LED chips 208 being arranged in groups. These LED chips 208 which emit light of colors of blue (B), green (G), and R (red) (when described below for each of the colors, the LED chip which emits light of blue is referred to as B-LED chip 208B, the LED chip which emits light of green is referred to as G-LED chip 208G, and the LED chip which emits light of red is referred to as R-LED chip 208R) are mounted onto a substrate 210 along the transverse direction of the photosensitive material 106 (i.e., the main scan direction) for each of the colors in accordance with the same arrangement rule. Meanwhile, the wavelength of light from the R-LED chip 208R is 650±20 nm, the wavelength of light from the G-LED chip 208G is 530±30 nm, and the wavelength of light from the B-LED chip 208G is 470±20 nm. On the substrate 210 in the plan view shown in FIG. 5, ten B-LED chips 208B are arranged in two rows and in a zigzag manner at the right end, ten R-LED chips 208R are arranged in two rows and in a zigzag manner at the left end, and ten G-LED chips 208G are arranged in two rows and in a zigzag manner at the central position. Namely, the totaled six rows of LED chips 208 are arranged.

A predetermined wiring arrangement is provided on the substrate 210 by etching processing or the like and each wire is covered by metal for heat dissipation so as not to cause a short circuit between the wires. For this reason, generation of heat due to the LED chips 208 being turned on can be restricted and variation of an amount by which light is emitted can also be limited.

The dimensions of each of parts of the light source portion 204 applied to the present embodiment are as follows.

The horizontal and vertical dimensions (X×Y) of the substrate 210 are 5×5 mm (maximum) and the dimensions of each LED chip 208 (x×y) are about 360×360 μm. The row pitch P of the same color LED chips is 600 μm, the line pitch L of each row of the LED chips is 520 μm, and the distance D of a stepped portion formed in the zigzag arrangement along the vertical direction of the substrate is 260 μm. The distance G of a space between the adjacent groups of LED chips cannot be determined unequivocally, but is determined by the telecentric lens 212. Preferably, the respective distances G between the R-LED chips 208R and the G-LED chips 208G and between the G-LED chips 208G and the B-LED chips 208B are equal to each other.

The diagonal line section of each of the LED chips 208 shown in FIG. 5 is a region from which light is actually emitted. As shown in the diagonal lines shown in FIG. 5, borders of the light emission region in the adjacent rows of LED chips are provided to coincide with each other.

The light source portion 204 having the above-described structure allows recording of a predetermined number of main scanning lines by one main scan operation for each of the colors. For this reason, step movement of the photosensitive material 106 is controlled such that the photosensitive material 106 is driven and stopped repeatedly at a pitch of the predetermined number of times the width of a main scanning line recorded thereon.

Reservoir Portion

The reservoir portion 170 is, as described above, disposed between the exposure section 176 and the water applying portion 178 and is formed by two pairs of nip rollers 192, 194 and one dancer roller 196. The photosensitive material 106 is entrained between the two pairs of nip rollers 192, 194 and a substantially U-shaped slack portion is formed in the photosensitive material 106 between these pairs of nip rollers. The dancer roller 196 moves up and down correspondingly to the slack portion to hold the slack portion of the photosensitive material 106.

In the exposure section 176, the photosensitive material 106 is moved in a stepwise manner, but in the water applying portion 178, it is necessary that the photosensitive material 106 be conveyed at a fixed speed so as to allow uniform application of water onto the photosensitive material 106. For this reason, the difference in the conveying speed of the photosensitive material 106 is generated between the exposure section 176 and the water applying portion 178. In order to eliminate the difference in the conveying speed, the dancer roller 196 moves up and down to adjust an amount of slack formed in the photosensitive material 106 so that the stepwise movement and the constant-speed movement of the photosensitive material 106 can be carried out synchronously.

Figure 7:
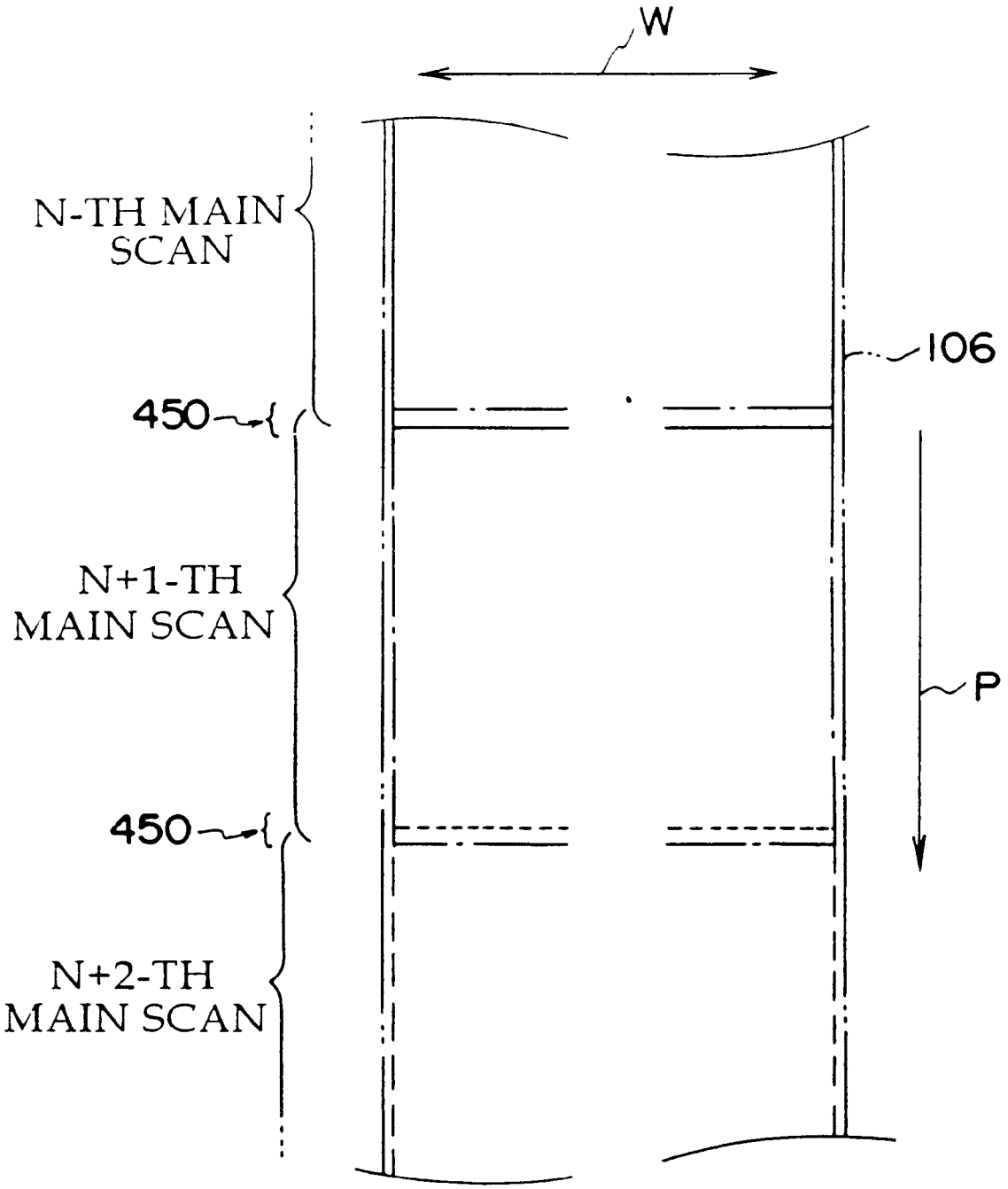
FIG. 7 is a conceptual plan view of a photosensitive material having been subjected to image forming processing in accordance with an exposure pattern relating to a first embodiment of the present invention.

In the image forming apparatus 100, as shown in FIG. 7, an overlapping region 450 in which some scan lines of a plurality of scan lines overlap with each other is provided in each of main scan operations. In the overlapping region, at least one scanning line is recorded by a combination of dots recorded by a preceding main scan operation and dots recorded by a succeeding main scan operation. Accordingly, an exposure pattern (recording pattern) along the main scan direction formed by the dots recorded in the overlapping region 450 by the preceding main scan operation and an exposure pattern along the main scan direction formed by the dots recorded in the overlapping region 450 by the succeeding main scan operation are previously set. In order that the scanning line is recorded in the overlapping region 450, the LED chips 208 are controlled to be set in an on-off state in accordance with the exposure patterns.

As shown in FIG. 6, the image forming apparatus 100 is provided with the pattern setting key 117 for setting the above-described exposure patterns to indicate exposure processing according to the exposure patterns.

The pattern setting key 117 is connected to an exposure control portion 400 to which an image signal read from the optical disk 102 or the FD 104 is inputted. The exposure control portion 400 previously stores a plurality of kinds of exposure pattern having different patterns and selects and sets one exposure pattern corresponding to an execution signal inputted from the pattern setting key 117, and then effects the image forming process. Further, the light-quantity correction unit 230 is connected to the exposure control portion 400 and a correction value is inputted from the light-quantity correction unit 230 to the exposure control portion 400.

Setting of the exposure pattern may be effected in such a manner that the pattern setting key 117 is operated to input data which indicates one exposure pattern without storing a plurality of exposure patterns in the exposure control portion 400.

Meanwhile, the exposure pattern may be set as the above-described pattern limited to the overlapping region, and also may be set as a pattern including an entire region to be recorded at one main scan operation.

Connected to the exposure control portion 400 are a main scan control portion 410 and a sub-scan control portion 412 which are provided in the controller 202. The main scan control portion 410 is connected via the driver 227 to the stepping motor 226 which moves the main scanning unit 206.

The sub-scan control portion 412 is connected via a driver 414 to a motor 416. The motor 416 is connected to and rotates the fourth roller pair 168 of the photosensitive material conveying system and the nip roller pair 192 of the reservoir portion (both of which are shown in FIG. 3). The sub-scan control portion 412 controls rotation of the motor 416 so as to rotate the fourth roller pair 168 and the nip roller pair 192 and causes the photosensitive material 106 to move stepwise by a predetermined amount in the sub-scan direction synchronous with the main scan operation by the main scan control portion 410.

The exposure pattern set by the exposure control portion 400 is inputted to the sub-scan control portion 412. The sub-scan control portion 412 determines an amount of sub-scan in accordance with the inputted exposure pattern so that an exposure region obtained by one main scan operation overlaps by the range of scanning lines corresponding to the exposure pattern in each main scan operation.

Further, an LED light-quantity adjusting portion 404 is connected to the exposure control portion 400 and the exposure pattern set in the exposure control portion 400 is inputted to the LED light-quantity adjusting portion 404. The LED light-quantity adjusting portion 404 adjusts, in accordance with the inputted exposure pattern, the LED chips 208 corresponding to the main scanning line of the overlapping region 450 in an off state or in an on-off controllable state. Namely, when dots are recorded by the LED chips in accordance with the exposure pattern, the LED chips are adjusted in the on-off controllable state. Further, when dots are not recorded, the LED chips are adjusted in the off state. In the present embodiment, the LED chips for recording the lowermost scanning line in the sub-scan direction in the overlapping region during the preceding main scan operation are adjusted in the on-off controllable state and in the off state in that order and the LED chips for recording the uppermost scanning line in the sub-scan direction in the overlapping region during the succeeding main scan operation are adjusted in the off state and in the on-off controllable state in that order (see FIG. 8).

The LED light-quantity adjusting portion 404 is connected to the LED emission control portion 408. The LED emission control portion 408 controls, based on digital image data which is an image signal, emission of light from the LED chips used to record dots in the overlapping region 450 and adjusted in an on-off controllable state and emission of light from the LED chips used to record dots in other region than the overlapping region 450.

Namely, in the image forming apparatus 100, an image is formed in accordance with the exposure pattern designated by the operation of the pattern setting key 117 so that the scanning line of the overlapping region 450 is recorded by a combination of dots recorded by the preceding main scan operation and dots recorded by the succeeding main scan operation.

Next, an operation of the present embodiment will be described.

An overall flow of the image forming process will be first described.

In the state in which the tray 144 is loaded in the tray mounting hole 146 and the feed reel 152 onto which the photosensitive material 106 is completely taken up and the take-up reel 154 which is in an empty state are mounted at respective predetermined positions, when a printing start key of the operation indication portion 112 is operated, the controller 202 reads and stores image data from the optical disk 102 or the FD 104.

When the image data is stored in the controller 202, the feed reel 152 is driven to start conveying the photosensitive material 106.

When the photosensitive material 106 reaches a predetermined position in the exposure section 176, the photosensitive material 106 is stopped temporarily and an image signal is outputted from the controller 202 to the light source portion 204. The image signal is outputted every ten lines and the light source portion 204 is guided by the guide shaft 218 by drive of the stepping motor 226 to move along the transverse direction of the photosensitive material 106 (main scan) and synchronously exposes the photosensitive material 106 at predetermined close intervals. As a result, the main scanning line formed from a large number of dots 280 is formed.

Further, prior to the outputting of the digital image signal, the quantity of light for each of the colors from the light source portion 204 is detected by the photodiode 228, and in the light-quantity correction unit 230, a correction value for adjustment of density, color balance, and the like is supplied for the controller 202, to thereby correct the image signal. The correction of the image signal is made for each image.

When the first main scan is completed, the photosensitive material 106 is moved one step at nine-line pitch and stops, and subsequently, a second main scan is effected. By repeating the above main scan, an image of one frame is recorded on the photosensitive material 106.

The photosensitive material 106 on which the image has been recorded is held by the drive of only the upstream side nip roller pair 192 in the reservoir portion 170 (a downstream side nip roller pair 194 is stopped) in the state of having a slack portion in the reservoir portion 170 to be entrained onto the dancer roller 196. For this reason, the above photosensitive material 106 does not reach the water applying portion 178.

When the photosensitive material 106 having a length of one image is accumulated in the reservoir portion 170, the nip roller pair 194 at the downstream side of the reservoir portion 170 starts driving. As a result, the photosensitive material 106 (recording of images thereon has been completed) is conveyed to the water applying portion 178. In the water applying portion 178, the photosensitive material 106 is conveyed at a constant speed and water is uniformly applied to the photosensitive material by the applying member 188.

Water is constantly conveyed from the tank 190 to the applying member 188 and the photosensitive material 106 is pressed by the applying member 188 at a predetermined pressure. For this reason, a proper amount of water is applied to the photosensitive material 106.

The photosensitive material 106 to which water is applied is guided by the guide plate 172 and is conveyed to the third roller pair 166.

On the other hand, the peripheral surface of the semicircular roller 156 and the leading end of the image receiving paper 108 contact each other due to one rotation of the semicircular roller 156, and the image receiving paper 108 of the uppermost layer is pulled out and is nipped by the first roller pair 160. The image receiving paper 108 is pulled out from the tray 144 by being driven by the first roller pair 160 and waits for arrival of the photosensitive material 106 in the state of being nipped by the second roller pair 162.

Synchronously with the passing of the photosensitive material 106 through the guide plate, the first roller pair 160 and the second roller pair 162 start driving and the image receiving paper 108 is guided by the guide plate 164 and conveyed to the third roller pair 166.

The photosensitive material 106 and the image receiving paper 108 are nipped by the third roller pair 166 in an overlapping state and are conveyed to the heat roller 174. At this time, the photosensitive material 106 and the image receiving paper 108 closely adhere to each other by water applied to the photosensitive material 106.

The photosensitive material 106 and the image receiving paper 108 in the overlapping state are entrained onto the heat roller 174 and is subjected to heat from the heater 182 for heat development-transfer processing. In other words, the image recorded on the photosensitive material 106 is transferred onto the image receiving paper 108 so as to form an image on the image receiving paper 108.

The heat development-transfer processing is completed in the state in which the image receiving paper 108 is wound onto the heat roller 174 by a length of about one third the entire circumference of the roller, and subsequently, the image receiving paper 108 is separated from the photosensitive material 106 by the peeling roller 184 and the peeling claw 186, and is discharged onto the discharge tray 140 in the state of being wound onto the peeling roller 184.

On the other hand, the photosensitive material 106 is wound onto the heat roller 174 by a length of about a half the overall circumference of the roller, and thereafter, the photosensitive material 106 moves in the tangential direction and is wound onto the take-up reel 154.

As a result, the image forming process can be conducted with a compact structure and an image to be recorded can be confirmed by the monitor portion 114, thereby resulting in adjustment of density or color balance being facilitated.

A description will be hereinafter given of the image forming process with reference to FIGS. 8A–C and 9. FIG. 9 shows an example of the image forming process according to a first embodiment of the present invention. In this embodiment, with one scanning line being overlapped in the overlapping region, the one scanning line is recorded by combination of the dots recorded in the preceding main scan operation and the dots recorded in the succeeding main scan operation.

When selection of the exposure pattern and the image forming process are indicated by the operation of the pattern setting key 117, in step 300, the exposure pattern is selected and set.

When the exposure pattern is set, in step 302, one step amount of sub-scan is determined in accordance with the exposure pattern. In the present embodiment, the overlapping region 450 formed from one main scanning line is exposed at two main scan operations, and therefore, one step amount is equal to an amount of nine line intervals.

When one step amount of sub-scan is determined, in step 304, digital image data of one main scan operation, i.e., of ten lines are taken in (fetched). Meanwhile, in the overlapping region, the lowermost scanning line in the sub-scan direction of the preceding scan operation and the uppermost scanning line in the sub-scan direction of the succeeding main scan operation are recorded overlapping with each other, and therefore, image data which records the overlapping region is redundantly taken in twice. Further, at this time, the digital image data taken in for all LED chips 208 is assigned.

When the digital image data is taken in, the main scan operation starts in step 306 and the state of the LED chips for recording the overlapping region is adjusted in accordance with the exposure pattern. Namely, the LED chips for recording the lowermost scanning line in the sub-scan direction of the preceding main scan operation in the overlapping region are adjusted in the on-off controllable state and in the off state in that order and the LED chips for recording the uppermost scanning line in the sub-scan direction of the succeeding main scan operation in the overlapping region are adjusted in the off state and in the on-off controllable state in that order (see FIGS. 8A to 8C).

In the subsequent step 310, it is determined whether the main scan operation has been completed or not. The decision of step 310 is no until the main scan operation has been completed, and exposure processing corresponding to image data is effected continuously.

Figure 8A:
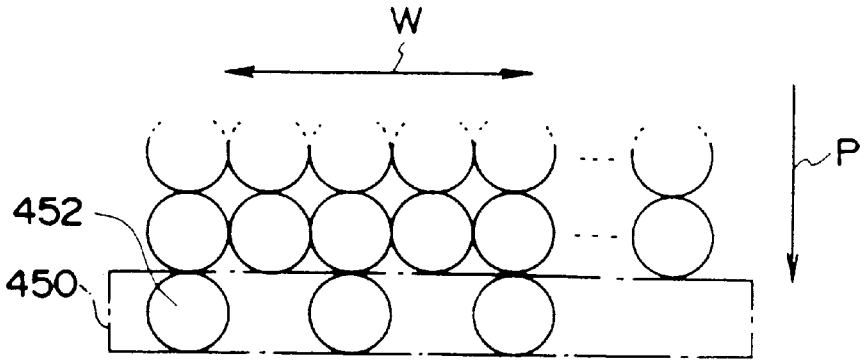
FIG. 8A is a conceptual diagram of an overlapping region caused by a n-th main scan-exposure operation according to the exposure pattern relating to the first embodiment.

In other words, as shown in FIG. 8A, when the main scan operation starts, a n-th main scan operation along the main scan direction indicated by W is effected. In this main scan operation, when the LED chips are adjusted in the on-off controllable state, the LED chips are controlled in the on-off state in accordance with the image data. When the LED chips are adjusted in an off state, the LED chips do not emit light irrespective of the image data, and therefore, the dots 452 located at a predetermined position and forming a part of the main scanning line are recorded as shown in FIG. 8A. Accordingly, after the n-th main scan-exposure operation, predetermined dots 452 corresponding to the exposure pattern are recorded in the overlapping region 450 and a partial main scanning line is formed. As a result, the configuration of the lowermost row of the overlapping region 450 in the sub-scan direction P is made uneven in the sub-scan direction P and extends along the main scan direction W (see the diagonal line section in FIG. 8C).

When one main scan operation is completed, the decision of step 310 is yes, and in step 312, the photosensitive material is moved in the sub-scan direction by an amount of one step determined by step 302. This sub-scan operation allows the overlapping region 450 obtained by the n-th main scan operation to be disposed below an exposure region in the subsequent main scan-exposure operation.

When the movement of the photosensitive material in the sub-scan direction is completed, in step 314, it is determined whether data for recording the succeeding main scanning line exists or not. When the main scanning lines for forming an image of one frame are not all recorded, the decision of step 314 is yes and the process proceeds to step 304, in which digital image data for the subsequent main scan operation is taken in and the subsequent main scan operation is effected.

Figure 8B:
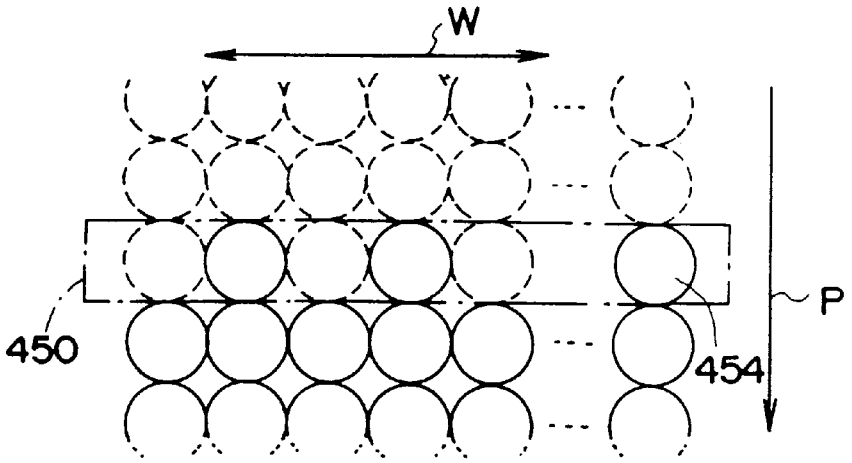
FIG. 8B is a conceptual diagram of an overlapping region caused by a n+1-th main scan-exposure operation, with the overlapping region being exposed overlapping with the overlapping region shown in FIG. 8A.
Figure 8C:
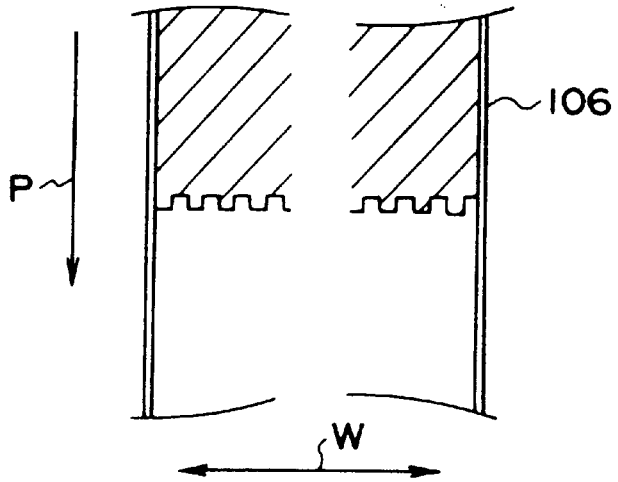
FIG. 8C is a plan view of a photosensitive material having been subjected to the n-th and n+1-th main scan-exposure operations.
Figure 9:
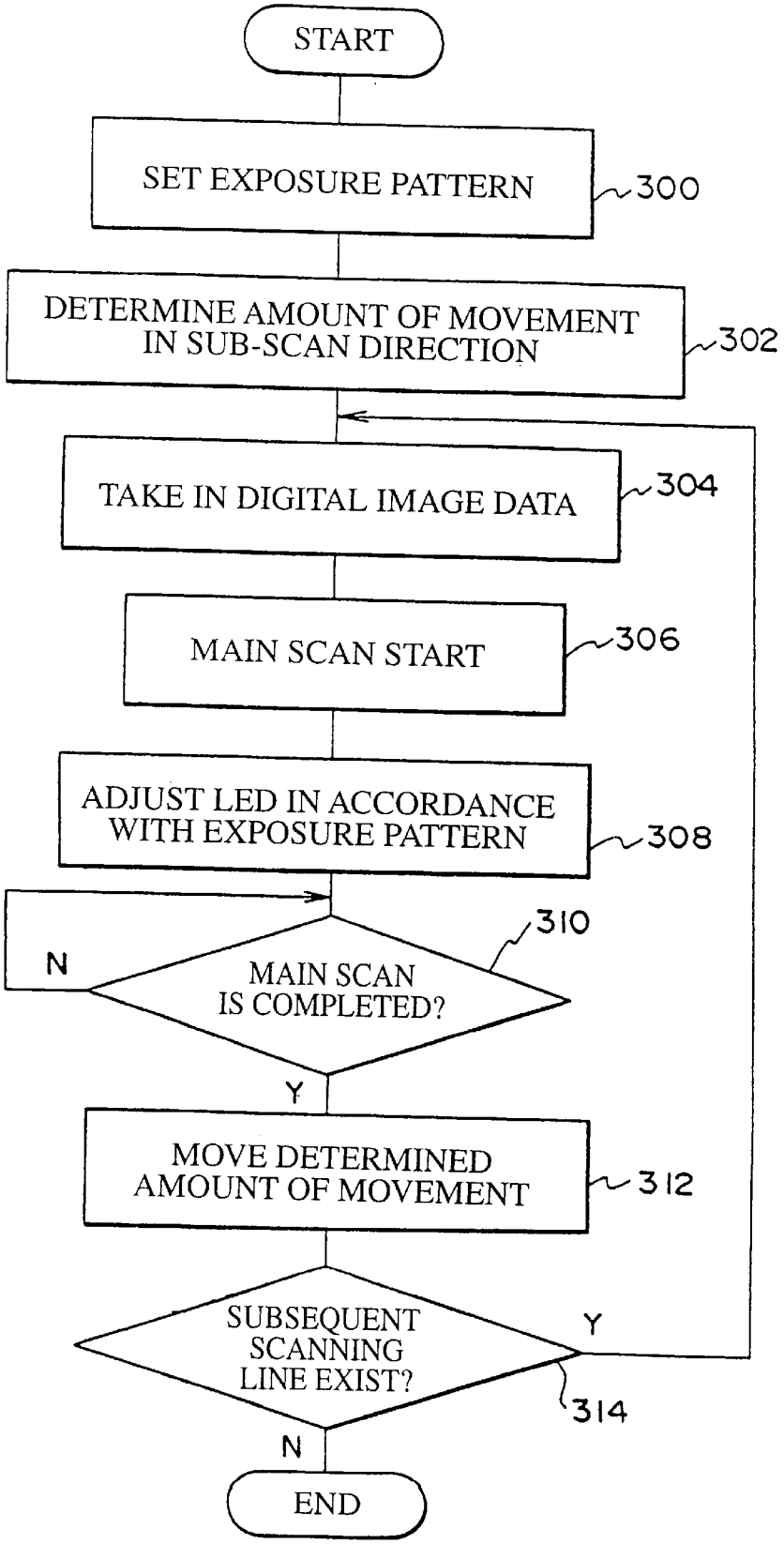
FIG. 9 is a flowchart which illustrates an example of an image forming process according to the first embodiment of the present invention.

As shown in FIG. 8B, in the n+1-th main scan operation, when the LED chips are adjusted in the on-off controllable state, dots 454 are formed based on image data at positions where dots are not formed in accordance with the exposure pattern in the preceding main scan operation, i.e., at positions where the dots 452 are not formed. Accordingly, after the n+1-th main scan-exposure operation, one main scanning line formed from the dots 452, 454 is formed in the overlapping region 450. The scanning line is formed with the dots 452 and the dots 454 being recorded alternately, and therefore, the boundary portion of a recording region obtained by the preceding main scan operation and a recording region obtained by the succeeding main scan operation extends unevenly along the main scan direction W (see FIG. 8C).

At this time, when an error occurs in the amount of movement in the sub-scan direction, respective positions where the dots 452 and the dots 454 are formed in engaged state are dislocated in the sub-scan direction P so that each space between the dots 452 and the dots 454 becomes wide or narrower. However, the difference in density caused by nonuniformity in the spaces of the dots is made uneven in accordance with the exposure pattern, and therefore, even if the error in the amount of movement occurs, linear unevenness extending in the main scan direction W is not formed. Further, the above uneven density in the shape of an indented line is not noticeable as a whole.

As described above, in the above-described embodiment, an image of high quality is formed by main scanning lines continuously recorded in the sub-scan direction P while exposing the overlapping region 450 twice in accordance with the exposure pattern.

On the other hand, when the main scanning lines for forming a desired image are all formed and a main scanning line which can be subsequently formed does not exist, the decision of step 314 is no and the routine ends. When a plurality of desired images exists, the routine is executed repeatedly to allow formation of a plurality of images.

Further, in the last main scan operation, the lowermost LED chips in the sub-scan direction are all adjusted in an on-off controllable state in accordance with image data so that the last scanning line is not formed in the shape of an indented line.

As described above, even if the error in the amount of movement in the sub-scan operation occurs, the linear uneven density extending in the main scan direction W is not noticeable, and therefore, an image of high quality can be formed efficiently without a finished quality thereof being deteriorated.

In the present embodiment, the number of main scanning lines in the overlapping region 450 is set at one, but the present invention is not limited to the same and a plurality of main scanning lines may be formed.

Figure 10A:
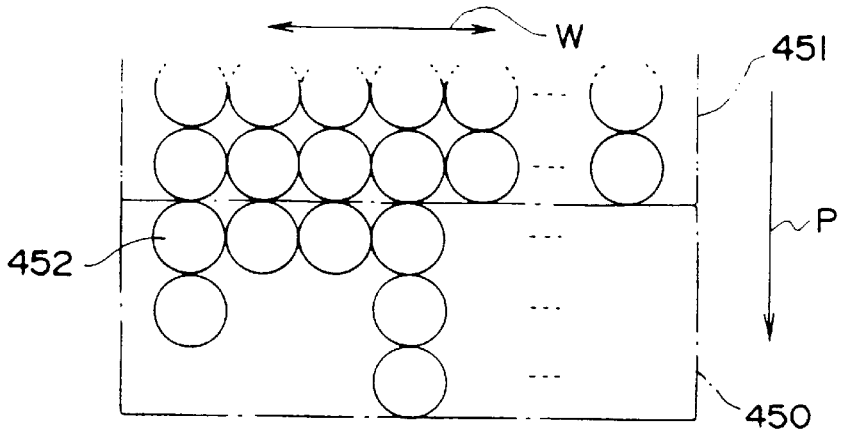
FIG. 10A is a conceptual diagram of an overlapping region caused by a n-th main scan-exposure operation according to an exposure pattern relating to a second embodiment of the present invention.
Figure 10B:
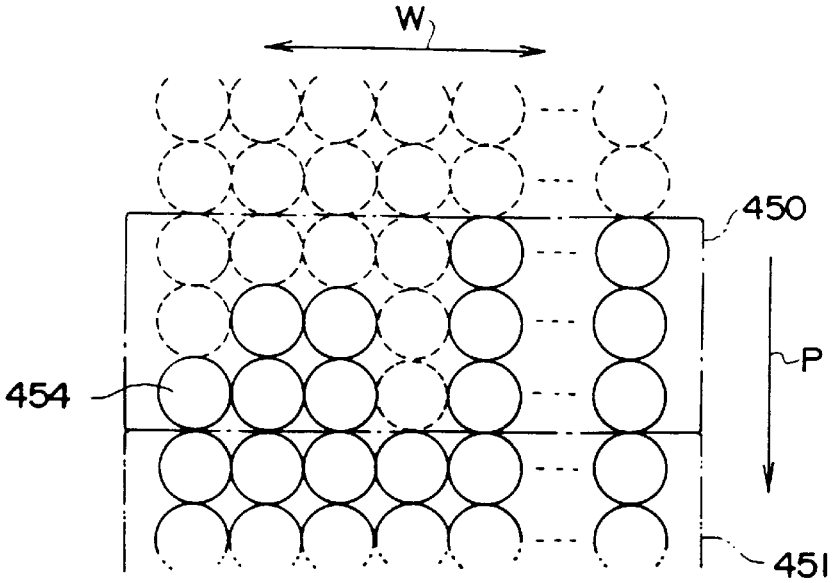
FIG. 10B is a conceptual diagram of an overlapping region caused by a n+10-th main scan-exposure operation, with the overlapping region being exposed overlapping with the overlapping region shown in FIG. 10A.
Figure 10C:
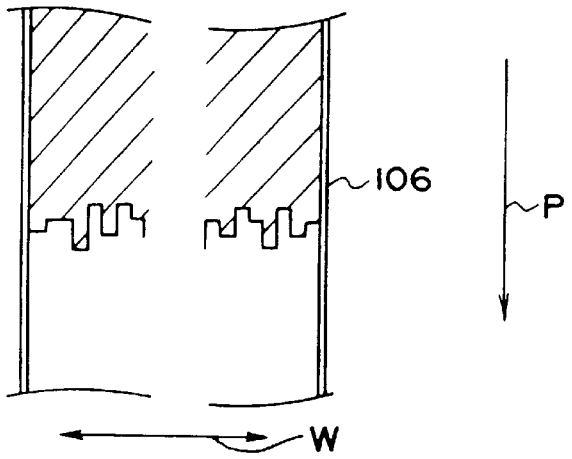
FIG. 10C is a plan view of a photosensitive material having been subjected to the n-th and n+1-th main scan-exposure operations.

FIGS. 10A–C shows a second embodiment in which three main scanning lines are formed in the overlapping region 450.

In this case, the above-described exposure pattern is applied to three sets of LED chips 208 correspond to the main scanning lines. In the exposure pattern shown in FIG. 10A, three main scanning lines are formed by two main scan-exposure operations.

As shown in FIG. 10A, the configuration of dots 452 within the overlapping region provided by the n-th main scan-exposure operation is formed from dots 452 disposed at the uppermost position of the overlapping region 450 in the sub-scan direction P continuously from a non-overlapping region 451 and also formed from one or two dots disposed below each of the above dots 452 in the sub-scan direction P. For this reason, after the n-th main scan-exposure operation, the lower side of a n-th recording region is made greatly indented along the main scan direction W by the dots 452 formed continuously and downward in the sub-scan direction P of the overlapping region 450 (see the diagonal line section in FIG. 10C).

In the n+1-th main scan-exposure operation, dots 454 are formed in the overlapping region 450 continuously from the non-overlapping region 451 at positions where the dots 452 are not formed. For this reason, as shown in FIG. 10B, the dots 454 are formed in an indented manner so as to be engaged with the dots 452 by the n+1-th main scan operation and three main scanning lines are thereby formed. The boundary portion of the dots 452 and the dots 454 is formed so as to be largely indented along the main scan direction W.

As described above, in the preceding and succeeding main scan operations, the dots are recorded in the overlapping region so that different numbers of dots are arranged in the sub-scan direction at positions adjacent along the main scan direction.

For this reason, even if the error in the amount of movement occurs during the sub-scan operation, density unevenness caused between the dots 452 and the dots 454 is formed to have a further complicated indented configuration. As a result, occurrence of linear unevenness extending in the main scan direction W is avoided and there is no possibility that the finished quality of an image is deteriorated.

Accordingly, even if the error in the amount of movement occurs during the sub-scan operation, an image of high quality can be efficiently formed without the finished quality thereof being deteriorated due to the linear unevenness extending along the main scan direction W.

In the present embodiment, the case in which an image is formed by using a single exposure pattern was described as an example, but the exposure pattern can be varied for each of the main scan operations. As a result, even if the error in an amount of movement occurs during the sub-scan operation, nonuniformity of the space of the dots in the sub-scan direction caused by the error in the amount of movement is formed as an irregular indented configuration in the sub-scan direction P. For this reason, the density unevenness is not made further noticeable and the finished quality of the image is not deteriorated.

In the present embodiment, the case in which the dots in the overlapping region are recorded by either the preceding main scan operation and the succeeding main scan operation in accordance with the exposure pattern was described as an example. However, at least one dot within the overlapping region can be recorded by overlapped exposure using the LED chips 208 corresponding to the main scanning line in the overlapping region 450. In this case, the amount of light from corresponding LED chips 208 is adjusted so that dots based on image data are obtained by overlapped exposure.

For this reason, in the n-th main scan-exposure operation, the dots 452 are formed by effecting a main scan operation with the amount of light from each of the LED chips 208 being varied in accordance with the exposure pattern. Due to the dots 452 thus formed, the difference in density which is formed as an indented configuration extending in the main scan direction occurs in the overlapping region 450. After sub-scan, in the n+1-th main scan-exposure operation, the amount of light of the LED chips 208 is varied in accordance with the exposure pattern and the dots 454 are formed in such a manner as to be overlapped with the dots 452 formed by the n-th main scan-exposure operation. The dots 454 thus obtained cause the difference in density having an indented configuration, which corresponds to and is formed in a reversed manner to the difference in density caused by the n-th main scan-exposure operation and extending indented in the main scan direction. These dots 452, 454 are formed overlapping with one another so that dots corresponding to image data are formed.

As described above, overlapped exposure is effected while varying the amount of light in the main scan direction in accordance with the exposure pattern, and therefore, dots of the amount of light corresponding to the digital image data are formed in the overlapping region 450.

For this reason, even if the error in an amount of movement occurs during sub-scan, the indented boundary portion which indicates the difference in density caused by the main scan-exposure operation and extending in the main scan direction is formed in an indented manner along the main scan direction W. As a result, there is no possibility that linear density unevenness extending in the main scan direction W occurs. Further, the dots 452 or the dots 454, each having a different amount of light depending on the exposure pattern, are formed to be dislocated from each other, and therefore, these dots appear to be formed continuously. As a result, an image can be formed without the finished quality thereof being deteriorated.

Meanwhile, in the case in which the amount of light of the LED chips 208 at one main scan-exposure operation is set at 50% of the amount of light of the digital image data in order that the main scanning line be formed in an overlapped state in the overlapping region 450 by two main scan operations, when a large number of dots is formed continuously in the main scan direction, the indented boundary portion based on the difference in the amount of light is not formed. For this reason, the continuous number of the dots is preferably reduced.

In each of the above-described embodiments, the boundary portion of the dots 452 and the dots 454 is formed in an indented manner, but the present invention is not limited to the same. For example, not only continuous dots 452, 453 but also discontinuous dots 452, 453 may also be included. In this case, the dots 452 or the dots 454 are formed intermittently at one main scan-exposure operation. As a result, the positions where the dots 452, 454 are formed in the overlapping region 450 are made further irregular. Accordingly, even if the error in amount of movement occurs during sub-scan, occurrence of streaked uneven density extending in the main scan direction W can be prevented still further.

In each of the above-described embodiments, in the exposure pattern, the position of a previously recorded dot 452 can be determined by using, for example, a random number. Further, the exposure pattern can also be varied for each of the main scan operations. As a result, even if the error in the amount of movement occurs during sub-scan, occurrence of linear unevenness extending in the main scan direction W is prevented still further and the finished quality of an image is not deteriorated.

Further, in each of the above-described embodiments, as the exposure pattern in the overlapping region 450 when a desired image is formed, any one of the above-described types in which the dots 452, 454 are formed can be selected. Further, these types may be used in combination. In this case, nonuniformity of the space of dots in the overlapping region 450 of a desired image becomes further irregular and an occurrence of streaked uneven density extending in the main scan direction W can be prevented still further.

In each of the above-described embodiments, the exposure pattern is previously set, but the present invention is not limited to the same. For example, the exposure pattern may also be read from the optical disk 102 or the FD 104 for each exposure processing.

According to each of the above-described embodiments, a large number of dots for forming the main scanning line is formed at two main scan-exposure operations in the overlapping region by selecting and setting the dots formed by a preceding main scan operation and the dots formed by a succeeding main scan operation in accordance with the exposure pattern. Accordingly, even if the error in an amount of movement occurs during sub-scan, unevenness in the space of the dots is formed along the exposure pattern and the occurrence of streaked uneven density extending in the main scan direction can be prevented.

Accordingly, deterioration of the finished quality of an image caused by streaked uneven density is prevented and an image of high quality (high resolution) can be efficiently formed.

Further, when the dots which are formed by one main scan operation to be arranged in the sub-scan direction are formed in the overlapping region so as to be dispersed in the main scan direction, the dispersed state of the dots results in a greatly indented portion extending in the sub-scan direction. Even if the error in an amount of movement occurs during sub-scan, ununiformity of the space of dots formed in a greatly indented manner occurs in the sub-scan direction. Accordingly, occurrence of streaked uneven density extending in the main scan direction can be prevented still further.

Moreover, when the dots formed by overlapped exposure are selected and dots are formed to obtain an amount of exposure corresponding to the digital image data by overlapped exposure, even if the error in an amount of movement occurs during sub-scan, the difference in density having an indented configuration caused by different amounts of exposure is formed in accordance with the exposure pattern so as to be dislocated along the exposure pattern. Accordingly, occurrence of uneven density extending in the main scan direction can be prevented.

Figure 11:
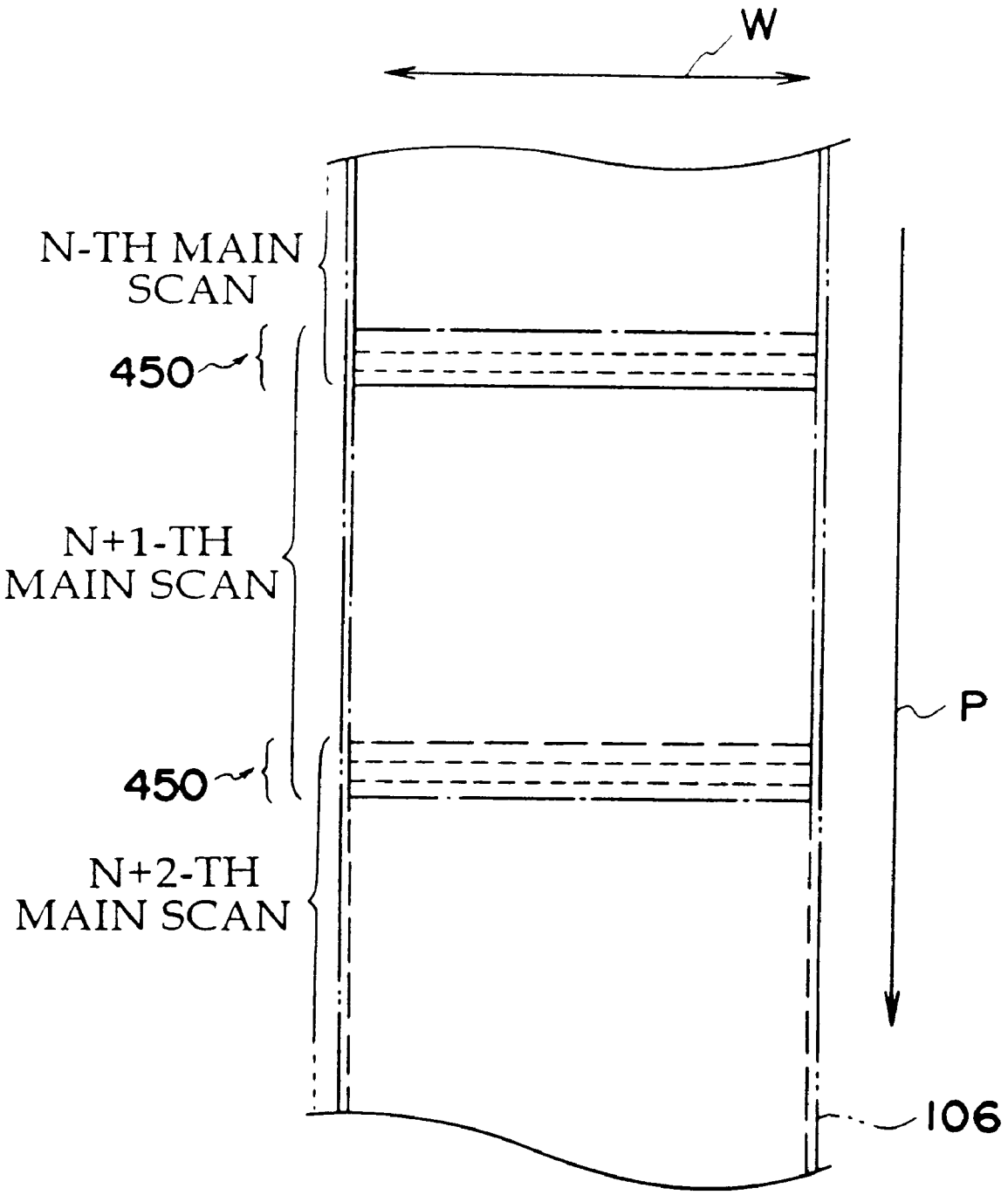
FIG. 11 is a conceptual plan view of a photosensitive material having been subjected to image forming processing in accordance with an exposure pattern relating to a third embodiment of the present invention.

Next, a third embodiment of the present invention will be described. In this embodiment, as shown in FIG. 11, an image is formed in such a manner that the overlapping region 450 is formed on the photosensitive material 106 and three main scanning lines are formed in the overlapping region 450 at two main scan operations. Accordingly, the exposure pattern which selects whether the LD chips 208 which can form the three main scanning lines of the overlapping region 450 are turned on by the preceding main scan operation or the LD chips 208 are turned on by the succeeding main scan operation is set by operation of the pattern setting key 117.

Figure 12A:
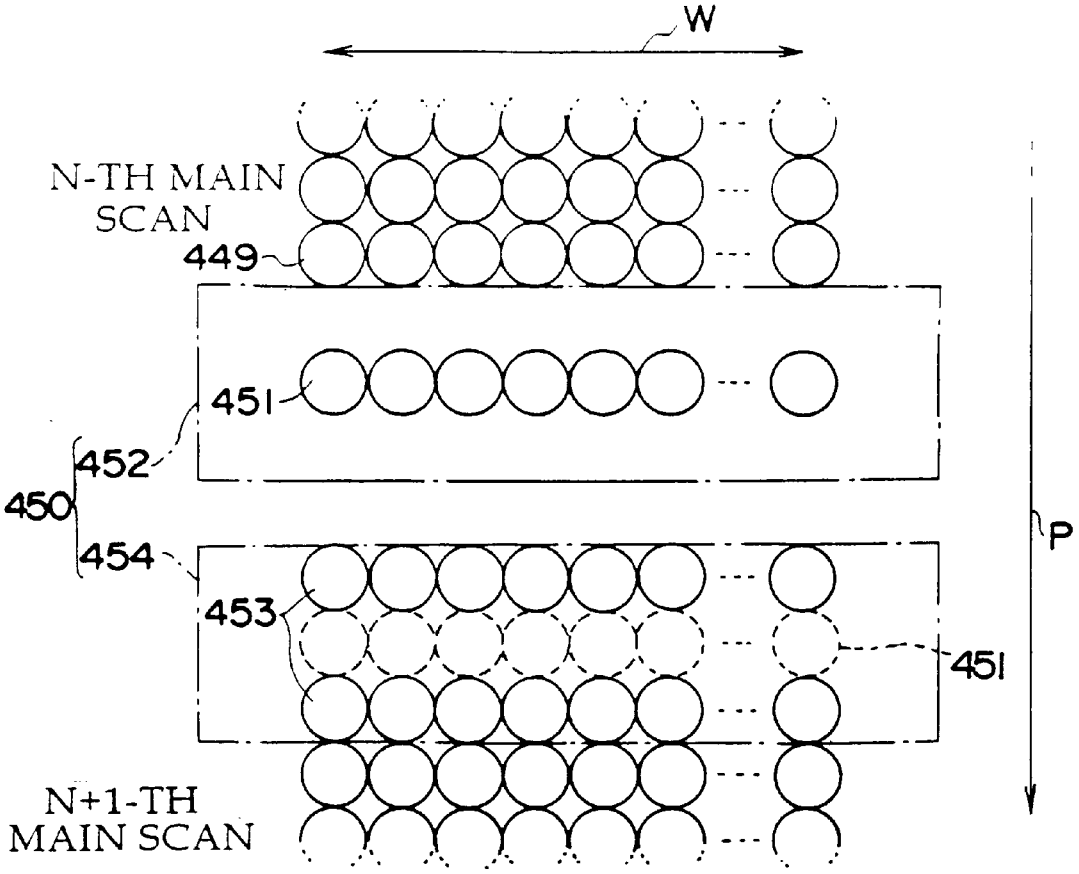
FIG. 12A is a conceptual diagram of dots formed in accordance with the exposure pattern relating to the third embodiment.

In this embodiment, an exposure pattern is set in which a central line of the scanning lines in the overlapping region 450 is recorded by the n-th main scan operation and the remaining two lines (upper and lower sides of the above central line) are recorded by the n+1-th main scan operation (see FIG. 12A). The above exposure pattern allows the LED chips 208 for recording the three main scanning lines of the overlapping region 450 to correspond to the main scanning lines, respectively.

An exposure pattern whose execution is indicated is inputted from the exposure control portion 400 to the sub-scan control portion 412. The sub-scan control portion 412 is provided to determine an amount of sub-scan in accordance with the input exposure pattern so that an exposure region obtained by one main scan operation overlaps by a range of scanning lines according to the exposure pattern in each of the main scan operation. In this embodiment, the amount of sub-scan is determined so that three main scanning lines overlap in the overlapping region.

The LED light-quantity adjusting portion 404 is connected to the exposure control portion 400 and an exposure pattern is inputted thereto from the exposure control portion 400. The LED light-quantity adjusting portion 404 adjusts, in accordance with the input exposure pattern, the LED chips 208 for recording the scanning line in the n-th main scan operation in an on-off controllable state. At this time, the LED chips 208 for recording the main scanning line in the n+1-th main scan-exposure operation are adjusted in an off state (see FIGS. 12A and 12B).

In the image forming apparatus 100 of this embodiment, emission of light of the LED chips is controlled based on image data so that the scanning line belonging to the overlapping region can be recorded by combination of a scanning line recorded by a preceding main scan operation and a scanning line recorded by a succeeding main scan operation while overlapping a portion of an exposure region which can be recorded at one main scan operation in accordance with the exposure pattern set correspondingly to the operation of the pattern setting key 117.

Next, the third embodiment of the present invention will be further described with reference to FIGS. 12 and 13. It should be noted that, in FIG. 13, the same members as those in FIG. 8 will be denoted by the same reference numerals. When an amount of movement in the sub-scan direction according to the exposure pattern is determined in step 302, in step 303, only the LED chips 208, among the three main scanning lines of the overlapping region 450, which the LED chips corresponding to a main scanning line which is selected to be recorded in accordance with the exposure pattern in the preceding main scan operation (i.e., the current main scan operation) are adjusted in the on-off controllable state. Further, the LED chips 208 corresponding to the main scanning lines which have not been selected to be recorded in the current main scan operation are adjusted in the off state.

When the state of the LED chips 208 corresponding to the overlapping region 450 is adjusted, image data is taken in (step 304) and the main scan operation starts (step 306).

As shown in FIG. 12A, when the main scan-exposure operation starts, recording of the scanning line is effected by the LED chips 208 adjusted in the on-off controllable state in accordance with the image data and the exposure pattern. In this embodiment, as shown in FIG. 12A, dots 451 for forming one central scanning line in the overlapping region in the n-th main scan operation are recorded. As a result, an overlapping pattern 452 at the side of the n-th main scan operation in which the dots 451 are recorded in the main scan direction W is recorded. Meanwhile, at this time, image data is supplied correspondingly to the LED chips adjusted in the off state. However, since the LED chips are adjusted in the off state, the LED chips do not emit light and no main scanning line is thereby recorded.

When it is determined that the n-th main scan operation has been completed in step 310, in step 312, the photosensitive material is moved in the sub-scan direction and the overlapping region 450 in which the only central main scanning line is formed by the n-th main scan-exposure operation is located within an exposure region at the subsequent main scan operation.

When it is determined that the subsequent main scanning line exists in step 314, in step 304, image data according to the subsequent main scan operation is taken in and the subsequent main scan operation is thereby effected.

As shown in FIG. 12A, the LED chips 208 adjusted in the on-off controllable state in the n+1-th main scan operation are used to form the dots 453 corresponding to the image data in the main scan direction W and the n+1-th overlapping pattern 454 is thereby formed. The n+1-th overlapping pattern 454 is formed overlapping with the overlapping region 450 in which the n-th overlapping pattern 452 is formed. As a result, two main scanning lines are formed adjacently to both sides of the central main scanning line formed by the dots 451 in the n-th main scan-exposure operation. Accordingly, among the three main scanning lines for forming the overlapping region 450, the central main scanning line is recorded by the n-th main scan-exposure operation and the remaining two main scanning lines are recorded by the n+1-th main scan-exposure operation.

Figure 12B:
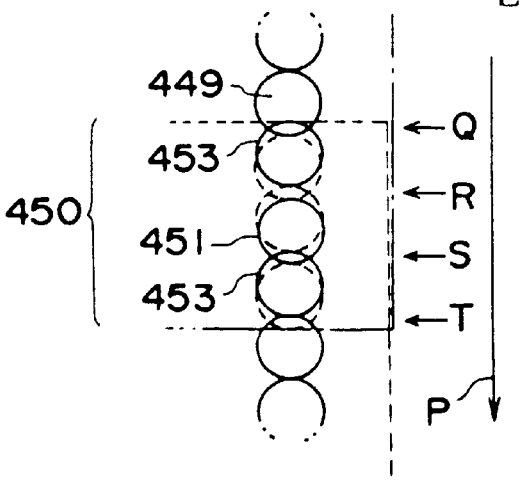
FIG. 12B is a partially enlarged diagram which shows the state in which the dots are formed overlapping with each other in FIG. 12A.
Figure 12C:
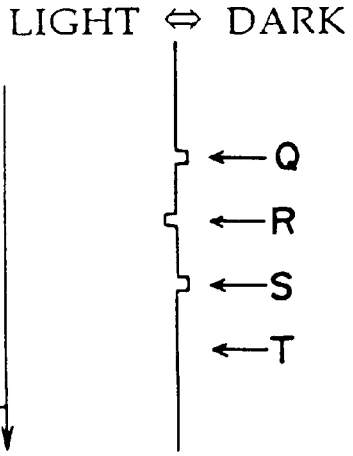
FIG. 12C is a diagram which shows variation in density.
Figure 13:
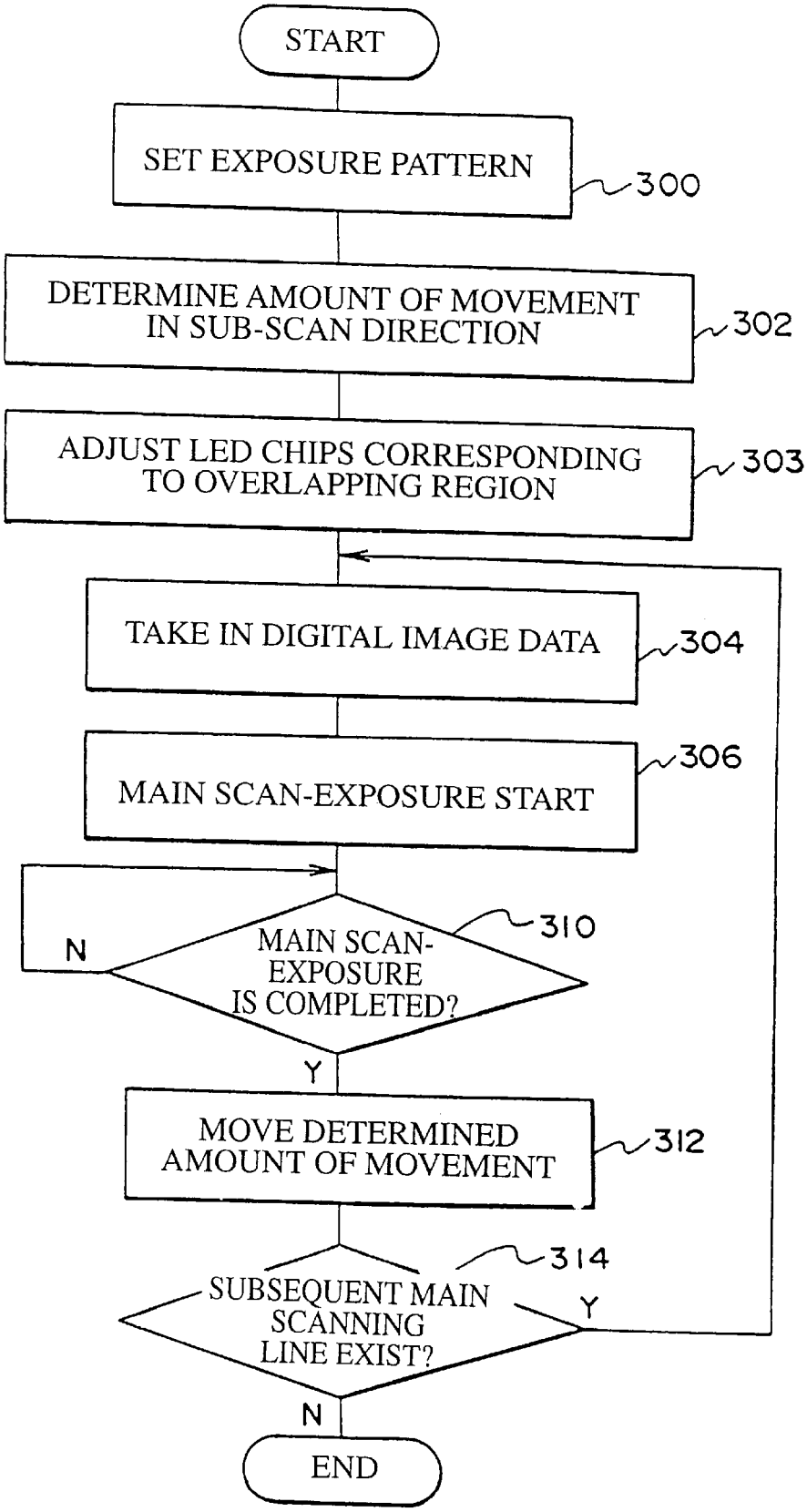
FIG. 13 is a flowchart which illustrates an example of an image forming process according to the third embodiment.

At this time, as shown in FIG. 12B, when the error in the amount of movement in the sub-scan direction occurs, the spaces between main scanning lines recorded by the n+1-th main scan operation and main scanning lines recorded by the n-th main scan operation are made nonuniform. Meanwhile, FIG. 12B shows a case in which the amount of movement in the sub-scan direction is set to be smaller than a determined value.

When the spaces between the main scanning lines in the n-th main scan operation and the main scanning lines in the n+1-th main scan operation are made smaller, dots 453 formed by the n+1-th main scan operation are overlapped, in other region than the overlapping region 450, with dots 449 formed in the non-overlapping region 449. Further, in the overlapping region 450, the dots 453 formed by the n+1-th main scan-exposure operation are overlapped with the dots 451 formed by the n-th main scan-exposure operation in the overlapping region 450 (see positions Q, S in FIG. 12B). The dots 451 and the dots 453 have the same quantity of light, and therefore, the density of each overlapping portion (the positions Q, S) becomes high (see FIG. 12C). On the other hand, no dot is formed at a portion where the space of the dots is made larger due to the n+1-th main scanning line dislocated (i.e., at the position R shown in FIG. 12B), and therefore, the density becomes low (see FIG. 12C).

For this reason, as shown by the positions Q, S, and R, each space of the main scanning lines is made nonuniform and the nonuniformity occurs at a short cycle. Linear uneven density extending in the main scan direction occurs due to the nonuniformity of the space, but the linear uneven density occurring at a short cycle is not noticeable in an entire image.

As described above, the main scan-exposure operation based on this exposure pattern is continuously effected while repeating sub-scan and an image formed by the main scan line continuing in the sub-scan direction can be thereby provided.

As a result, even if the error in an amount of movement during sub-scan occurs, an image of high quality can be efficiently formed without the finished quality thereof being damaged by streaked uneven density extending in the main scan direction.

In the above-described embodiment, the case in which an image is formed by using a single exposure pattern was described as an example, but the number of exposure patterns may not be limited at one as described below.

Figure 14:
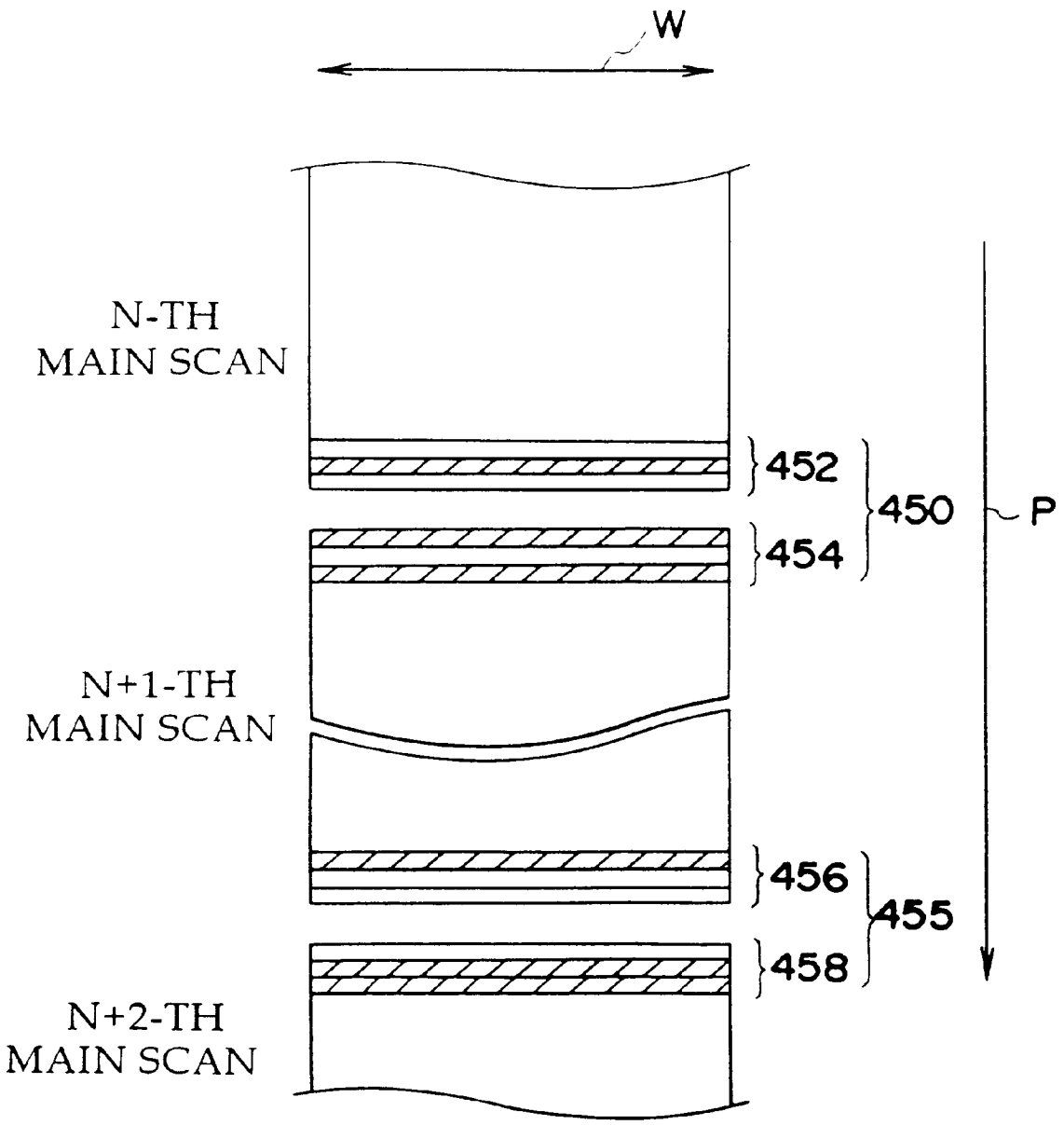
FIG. 14 is a conceptual diagram of a photosensitive material subjected to image forming processing in accordance with another exposure pattern of the third embodiment.

FIG. 14 shows, as an example, a case in which a different LED chip 208 to be previously turned on is selected, among the LED chips for recording the main scanning line of the overlapping region 450, for each main scan operation and a scanning line is recorded in the overlapping region by a different combination of a scanning line recorded by the preceding main scan operation and a scanning line recorded by the succeeding main scan operation. Meanwhile, in FIG. 14, diagonal-line portions in the scanning lines of the overlapping regions 450, 455 indicate the main scanning lines recorded by the LED chips 208 adjusted in an on-off controllable state.

In the above example, in the overlapping region 450, the central scanning line is recorded by the preceding main scan operation and the remaining scanning lines are recorded by the succeeding main scan operation. Further, in the overlapping region 450, the uppermost scanning line of the overlapping region is recorded by the preceding main scan operation and the remaining scanning lines are recorded by the succeeding main scan operation. Meanwhile, numerals 456, 458 each designate an overlapping pattern.

As described above, an image is formed by using a different exposure pattern for each main scan operation, and therefore, even if the error in the amount of movement in the sub-scan direction occurs, a cycle at which the space of the main scanning lines is made nonuniform can be made shorter and can be provided differently for each of the main scan operations.

As described above, the nonuniformity of the space of the main scanning lines is caused at a different cycle for each of the main scan operations, and therefore, uneven density is made into an irregular linear state. As a result, uneven density can be made unnoticeable still further.

The above-described exposure pattern can be formed by selecting the main scanning lines previously formed in the overlapping regions 450, 455 with a random number or the like used. As a result, it is possible to prevent the pattern from being repeated at a fixed cycle and also allow the uneven density to be made unnoticeable still further by making a cycle at which the linear uneven density appears irregular.

Further, a single exposure pattern repeatedly applied and various exposure patterns which can be changed for each of the main scan operations can be set selectively. In this case, selection means can be provided which can select an arbitrary exposure pattern.

Meanwhile, in the foregoing, the number of main scanning lines belonging to the overlapping region is set at three, but the present invention is not limited to this number. So long as the overlapping region is formed by at least two main scanning lines, the above-described effects can be obtained. However, when the number of main scanning lines belonging to the overlapping region increases, the number of main scanning lines formed at a time decreases, and therefore, the number of main scanning lines belonging to the overlapping region is determined from the viewpoint of processing efficiency. When two main scanning lines belong to the overlapping region, the main scanning line located at a lower side in the sub-scan direction P is first recorded.

In the above-described embodiment, the case in which the LED chips 208 are adjusted in an on-off controllable state in accordance with the exposure pattern was described and the present invention is not limited to the same.

By referring to FIG. 15, a description will be hereinafter given of a fourth embodiment in which at least one scanning line is recorded in an overlapping region by combination of a scanning line recorded in a preceding main scan operation and a scanning line recorded by a succeeding main scan operation in a state of overlapping with the scanning line recorded in the previous main scan operation.

Figure 15:
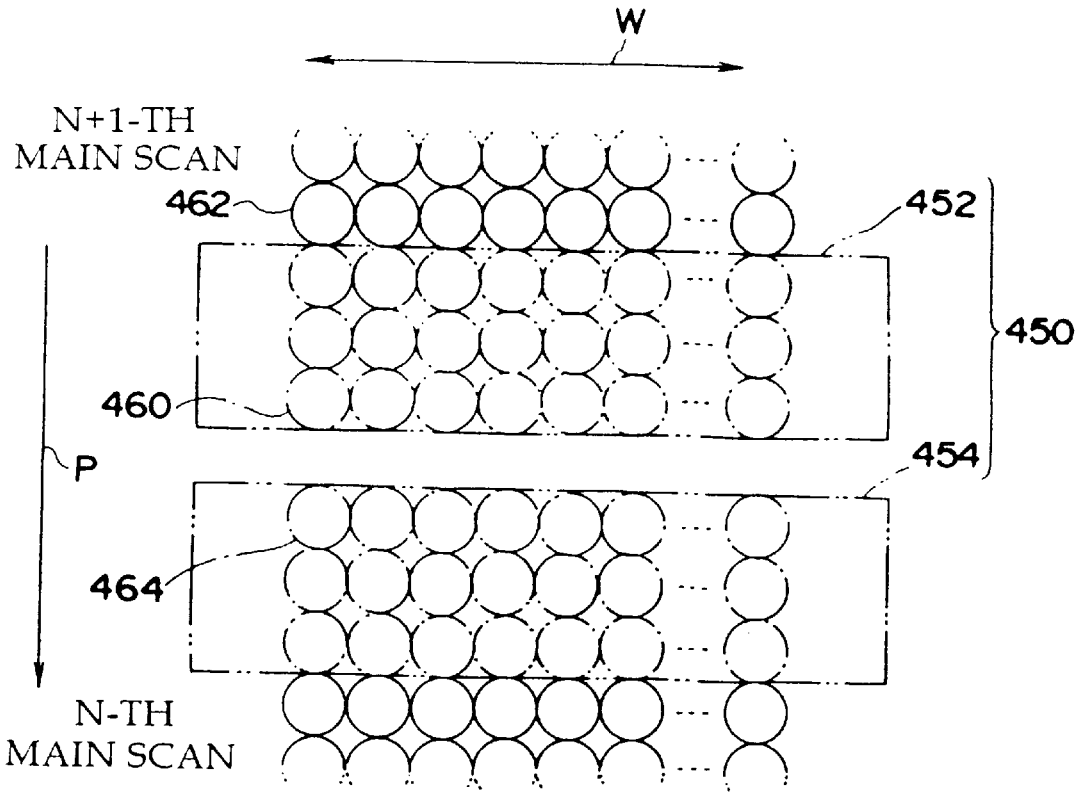
FIG. 15 is a conceptual diagram of dots formed in accordance with an exposure pattern relating to a fourth embodiment of the present invention.

In the exposure pattern shown in FIG. 15, dots 460 of a nth exposure pattern are formed by a n-th main scan-exposure operation and dots 464 of a n+1-th exposure pattern are formed by the n+1-th main scan-exposure operation. The amounts of light emitted from the LED chips 208 for forming each of the dot 460 and the dot 464 is synthesized by overlapped exposure so as to be adjusted to the amount of light based on digital image data. Meanwhile, so long as the total amount of light emitted from a pair of LED chips 208 for recording the same dot is the same as the amount of light of image data corresponding to the dot, the pair of LED chips 208 may have different amounts of light or may have the same amount of light.

As described above, when overlapped exposure is effected by the n-th and n+1-th main scan-exposure operations, the dots 460, 464 are formed overlapping in the overlapping region 450 and a predetermined amount of exposure is thereby obtained. As a result, the main scanning line in the overlapping region 450 is formed at the same density as that of a main scanning line in another region and an image having a uniform density is thereby formed.

In this embodiment, an error in an amount of movement occurs during sub-scan and a difference in density between a portion where the dots 460, 462 overlap with each other and another dot thereby becomes smaller.

For example, when the pair of LED chips 208 for recording the same dot has the same amount of light, i.e., each have 50% of the total amount of light, even if the dot 460 and the dot 462 overlap with each other, the density of these dots merely comes to a value of approximately one and a half times the density of the dot 462. For this reason, the difference in density can be lessened. On the other hand, when the pair of LED chips 208 for recording the same dot have the different amounts of light, the difference in density between the portions where the dots overlap can be formed continuously at a higher density.

As a result, streaked uneven density extending in the main scan direction W can be made unnoticeable still further.

In the exposure pattern in which each amount of light from the pair of LED chips 208 is adjusted, the number of main scanning lines belonging to the overlapping region is set at three, but the present invention is not limited to this number. In a case in which at least two main scanning lines belong to the overlapping region 450, the total amount of light of the corresponding pair of LED chips 208 is set to be equal to that of LED chips 208 in another region, thereby resulting in achievement of the above-described effects.

In the above exposure pattern, when the corresponding pair of LED chips 208 has the different amounts of light, the amount of light of each of the LED chips 208 can be varied for each of the main scan operations. As a result, the cycle at which streaked uneven density occurring when the amount of movement and the amount of sub-scan are different from each other and extending in the main scan direction appears is made further irregular so that the streaked uneven density is made unnoticeable.

Meanwhile, in one main scan-exposure operation, the main scanning lines belonging to the overlapping region 450 can be all formed by using the same amount of light or using different amounts of light, respectively. In either case, the above-described effects can be obtained.

In this embodiment, although the exposure pattern is previously set, the present invention is not limited to the same. For example, the exposure pattern may be read from the optical disk 102 or the FD 104 for each exposure processing.

In each of the above-described embodiments, the main scanning lines in the overlapping region are formed by either of the two main scan operations, and therefore, a plurality of boundary portions can be formed between the main scanning lines in the current main scan-exposure operation and each of the main scanning lines in an the preceding and succeeding main scan-exposure operations. Even if an error in amount of movement during sub-scan occurs, the cycle at which the space of main scanning lines is made nonuniform can be reduced. Accordingly, even if the error in amount of movement during sub-scan occurs, linear uneven density extending in the main scan direction is made unnoticeable and the finished quality is not deteriorated. Further, an image of high quality (high resolution) can be efficiently formed accordingly.

Further, since the main scanning lines are provided in the overlapping region in such a manner as to be exposed by overlapped exposure, a plurality of boundary portions can be formed between the main scanning line in the current main scan-exposure operation and each of the main scanning lines in the preceding or succeeding main scan-exposure operations. Even if the amount of movement during sub-scan is different from an actual amount of movement, the cycle at which the space of the main scanning lines is made non-uniform can be shortened. Accordingly, the finished quality is not deteriorated and an image of high quality (high resolution) can be efficiently formed.

Moreover, in each of the above-described embodiments, light emitting elements selected from the main scanning lines in the overlapping region so as to be turned on during the current main scan-exposure operation or light emitting elements selected from the main scanning lines in the overlapping region so as to correspond to an overlapping-exposed main scanning line are selected for each of the main scan operations. For this reason, even if the amount of sub-scan and the actual amount of movement are different from each other, a streaked uneven density extending in the main scan direction is made irregular and can be made further unnoticeable in the image formed as described above.

What is claimed is:

1. An image forming apparatus comprising:

a light source in which at least one row of light emitting elements, which is formed from a plurality of light emitting elements arranged along a predetermined direction, is provided;

moving means which moves at least one of said light source and a photosensitive material in a main scan direction crossing the predetermined direction and in a sub-scan direction along the predetermined direction, respectively;

first control means which controls said moving means so that a plurality of scanning lines are recorded synchronously at one main scan operation and at least one scanning line is formed overlapping each other in each main scan operation; and second control means which controls emission of light of the light emitting elements based on image data so that at least one scanning line is recorded in an overlapping region, in which the scanning lines overlap each other, by a combination of dots recorded by a preceding main scan operation and dots recorded by a succeeding main scan operation.

2. An image forming apparatus according to claim 1, wherein said second control means controls said emission in the overlapping region so that one of the dots recorded by the preceding main scan operation and the dots recorded by the succeeding main scan operation are recorded between other dots in the main scan direction in said scanning line.

3. An image forming apparatus according to claim 1, wherein said second control means controls said emission in the overlapping region in such a manner that the dots recorded by the preceding main scan operation and the dots recorded by the succeeding main scan operation are previously set.

4. An image forming apparatus according to claim 1, wherein said second control means controls said emission in the overlapping region so that the combination of the dots recorded by the preceding main scan operation and the dots recorded by the succeeding main scan operation varies in each overlapping region of adjacently overlapping regions.

5. An image forming apparatus according to claim 1, wherein said second control means controls said emission in the preceding main scan operation and the succeeding main scan operation with elements emitting light in the overlapping region being arranged in the sub-scan direction each at adjacent positions in the main scan direction.

6. An image forming apparatus according to claim 1, wherein said second control means controls said emission in the overlapping region so that at least a portion of one scanning line is recorded by combination of the dots recorded by the preceding main scan operation and dots recorded by the succeeding main scan operation in a state of overlapping with the dots recorded by the preceding main scan operation.

7. An image forming apparatus according to claim 6, wherein amounts of light of adjacent light emitting elements for recording one of the dots recorded by the preceding main scan operation and the dots recorded by the succeeding main scan operation are set differently.

8. An image forming apparatus comprising:

a light source in which at least one row of light emitting elements, which is formed from a plurality of light emitting elements arranged along a predetermined direction, is provided;

moving means which moves at least one of said light source and a photosensitive material in a main scan direction crossing the predetermined direction and in a sub-scan direction along the predetermined direction, respectively;

first control means which controls said moving means so that a plurality of scanning lines are recorded synchronously at one main scan operation and a region which can be recorded by a preceding main scan operation and a region which can be recorded by a succeeding main scan operation are partially overlapped with each other in each main scan operation; and second control means which control emission of light of the light emitting elements based on image data so that scanning lines belonging to an overlapping region with the recording regions overlapping each other are recorded in the overlapping region by a combination of at least one scanning line recorded by the preceding main scan operation and at least one scanning line recorded by the succeeding main scan operation.

9. An image forming apparatus according to claim 8, wherein said second control means controls said emission in the overlapping region so that one of the scanning lines recorded by the preceding main scan operation and the scanning line recorded by the succeeding main scan operation are recorded between the other scanning lines.

10. An image forming apparatus according to claim 8, wherein said second control means controls said emission in the overlapping region in such a manner that the scanning line recorded by the preceding main scan operation and the scanning line recorded by the succeeding main scan operation are previously set.

11. An image forming apparatus according to claim 8, wherein said second control means controls said emission in the overlapping region so that the combination of the scanning line recorded by the preceding main scan operation and the scanning line recorded by the succeeding main scan operation varies in each overlapping region of adjacently overlapping regions.

12. An image forming apparatus according to claim 8, wherein said second control means controls said emission in the overlapping region so that at least one scanning line is recorded by the combination of the scanning line recorded by the preceding main scan operation and scanning line recorded by the succeeding main scan operation to overlap with the scanning line recorded by the preceding main scan operation.

13. An image forming apparatus according to claim 8, wherein said second control means controls said emission in the overlapping region in such a manner that light emitting elements emitting light in the preceding main scan operation and light emitting elements emitting light in the succeeding main scan operation are previously set.

14. An image forming apparatus according to claim 13, wherein said second control means controls said emission in the overlapping region by recording scanning lines in a overlapping state using the light emitting elements, which emit light in the preceding main scan operation, and emit light in the succeeding main scan operation.

15. An image forming apparatus according to claim 8, wherein said second control means controls said emission in the overlapping region in such a manner that light emitting elements emit light only in the preceding main scan operation and light emitting elements emitting light only in the succeeding main scan operation are previously set.

16. An image forming apparatus according to claim 15, wherein one of the light emitting elements emitting light only in the preceding main scan operation and the light emitting elements emitting light only in the succeeding main scan operation are located between the other light emitting elements.

* * * * *